US011061362B2

(12) United States Patent
Ichikawa et al.

(10) Patent No.: US 11,061,362 B2
(45) **Date of Patent: *Jul. 13, 2021**

(54) IMAGE FORMING APPARATUS

(71) Applicant: BROTHER KOGYO KABUSHIKI KAISHA, Nagoya (JP)

(72) Inventors: Tomoya Ichikawa, Nagoya (JP); Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/858,884

(22) Filed: Apr. 27, 2020

(65) Prior Publication Data

US 2020/0257244 A1 Aug. 13, 2020

Related U.S. Application Data

(63) Continuation of application No. 16/517,808, filed on Jul. 22, 2019, now Pat. No. 10,663,917.

(30) Foreign Application Priority Data

Sep. 21, 2018 (JP) ..... JP2018-177647

(51) Int. Cl.
*G03G 21/18* (2006.01)
*G03G 21/16* (2006.01)

(52) U.S. Cl.
CPC ..... *G03G 21/1842* (2013.01); *G03G 21/1619* (2013.01); *G03G 21/1633* (2013.01);
(Continued)

(58) Field of Classification Search
CPC ..... G03G 21/1619; G03G 21/1633; G03G 21/1676; G03G 21/1839; G03G 21/1842;
(Continued)

(56) References Cited

U.S. PATENT DOCUMENTS 9,304,484 B2 * 4/2016 Ogino ..... G03G 21/1666
9,342,035 B2 5/2016 Sato
(Continued)

FOREIGN PATENT DOCUMENTS

JP 2006-184552 A 7/2006
JP 2006-235320 A 9/2006
(Continued)

*Primary Examiner* — Ryan D Walsh
(74) *Attorney, Agent, or Firm* — Merchant & Gould P.C.

(57) ABSTRACT

A first drawer configured to support a drum cartridge moves in a first direction between a first mount position and a first detachment position. A second drawer configured to support a development cartridge moves in the first direction between a second mount position and a second detachment position. The second drawer is located between the first drawer located at the first mount position and a cover located at a closed position with respect to the first direction in a state where the second drawer is located at the second mount position. A lock member moves between a lock position at which the first drawer and the second drawer are locked together and a lock release position at which a lock state between the first drawer and the second drawer is released. A lock release member causes the lock member at the lock position to move to the lock release position.

9 Claims, 16 Drawing Sheets

(52) U.S. Cl.
CPC ..... *G03G 21/1676* (2013.01); *G03G 21/1839* (2013.01); *G03G 2221/1678* (2013.01); *G03G 2221/1684* (2013.01); *G03G 2221/183* (2013.01); *G03G 2221/1869* (2013.01)

(58) Field of Classification Search
CPC ... G03G 2221/1678; G03G 2221/1684; G03G 2221/183; G03G 2221/1869
See application file for complete search history.

(56) References Cited

U.S. PATENT DOCUMENTS

| | | | | |
|---|---|---|---|---|
| 10,216,118 | B2 | 2/2019 | Minoshima et al. | |
| 10,663,916 | B2 * | 5/2020 | Sato | G03G 21/1676 |
| 10,663,917 | B2 * | 5/2020 | Ichikawa | G03G 21/1842 |
| 2004/0190932 | A1 | 9/2004 | Ishii | |
| 2006/0140673 | A1 | 6/2006 | Kamimura et al. | |
| 2006/0193674 | A1 | 8/2006 | Matsushima | |
| 2006/0228131 | A1 | 10/2006 | Kimura et al. | |
| 2009/0285593 | A1 | 11/2009 | Sakuma | |
| 2009/0317133 | A1 | 12/2009 | Nishimura et al. | |
| 2009/0324283 | A1 | 12/2009 | Mushika et al. | |
| 2010/0247142 | A1 | 9/2010 | Kikuchi et al. | |
| 2010/0303499 | A1 | 12/2010 | Mori et al. | |
| 2011/0026968 | A1 | 2/2011 | Ishii et al. | |
| 2011/0293317 | A1 | 12/2011 | Nakano et al. | |
| 2012/0183325 | A1 | 7/2012 | Sato | |
| 2012/0294646 | A1 | 11/2012 | Suzuki et al. | |
| 2013/0004200 | A1 | 1/2013 | Okabe | |
| 2015/0277365 | A1 | 10/2015 | Sato | |
| 2015/0346679 | A1 | 12/2015 | Kusano et al. | |
| 2016/0103418 | A1 | 4/2016 | Yada et al. | |
| 2017/0160697 | A1 | 6/2017 | Sato et al. | |
| 2019/0361383 | A1 | 11/2019 | Sato | |
| 2019/0384217 | A1 | 12/2019 | Sato | |
| 2019/0384219 | A1 | 12/2019 | Sato | |

FOREIGN PATENT DOCUMENTS

| | | | |
|---|---|---|---|
| JP | 2010-8511 | A | 1/2010 |
| JP | 2010-276961 | A | 12/2010 |
| JP | 2015-197517 | A | 11/2015 |
| JP | 2016-81034 | A | 5/2016 |

* cited by examiner

IMAGE FORMING APPARATUS

CROSS REFERENCE TO RELATED APPLICATIONS

This application is a continuation of U.S. patent application Ser. No. 16/517,808, filed Jul. 22, 2019, which further claims priority from Japanese Patent Application No. 2018-177647 filed Sep. 21, 2018. The entire content of the priority application is incorporated herein by reference.

TECHNICAL FIELD

This disclosure relates to an image forming apparatus.

BACKGROUND

Conventionally, a cartridge and an image forming apparatus including a drawer supporting a cartridge are known. The cartridge includes a photosensitive drum and a development unit having a development roller. The drawer is movable between a mount position at which the cartridge is mounted on the image forming apparatus and a detachment position at which the cartridge can be detached.

SUMMARY

According to one aspect, this specification discloses an image forming apparatus. The image forming apparatus includes a housing, a cover, a drum cartridge, a development cartridge, a first drawer, a second drawer, a lock member, and a lock release member. The housing is formed with an opening. The cover is configured to move between a closed position at which the opening is closed and an open position at which the opening is opened. The drum cartridge includes a photosensitive drum. The development cartridge includes a development roller. The first drawer is configured to support the drum cartridge. The first drawer is configured to move in a first direction between a first mount position at which the drum cartridge is mounted on the image forming apparatus and a first detachment position at which the drum cartridge is detachable. The second drawer is configured to support the development cartridge. The second drawer is configured to move in the first direction between a second mount position at which the development cartridge is mounted on the image forming apparatus and a second detachment position at which the development cartridge is detachable. The second drawer is located between the first drawer located at the first mount position and the cover located at the closed position with respect to the first direction in a state where the second drawer is located at the second mount position. The lock member is configured to move between a lock position at which the first drawer and the second drawer are locked together and a lock release position at which a lock state between the first drawer and the second drawer is released. The lock release member is configured to cause the lock member located at the lock position to move to the lock release position.

BRIEF DESCRIPTION OF THE DRAWINGS

Embodiments in accordance with this disclosure will be described in detail with reference to the following figures wherein.

DETAILED DESCRIPTION

In the above-described image forming apparatus, there is a need to replace the photosensitive drum and the development unit separately (individually).

In view of the foregoing, an example of an object of this disclosure is to provide an image forming apparatus in which a drum cartridge including a photosensitive drum and a development cartridge including a development roller can be replaced separately.

1. Outline of Image Forming Apparatus 1

An outline of an image forming apparatus 1 will be described while referring to FIGS. 1 and 2.

Figure 1:
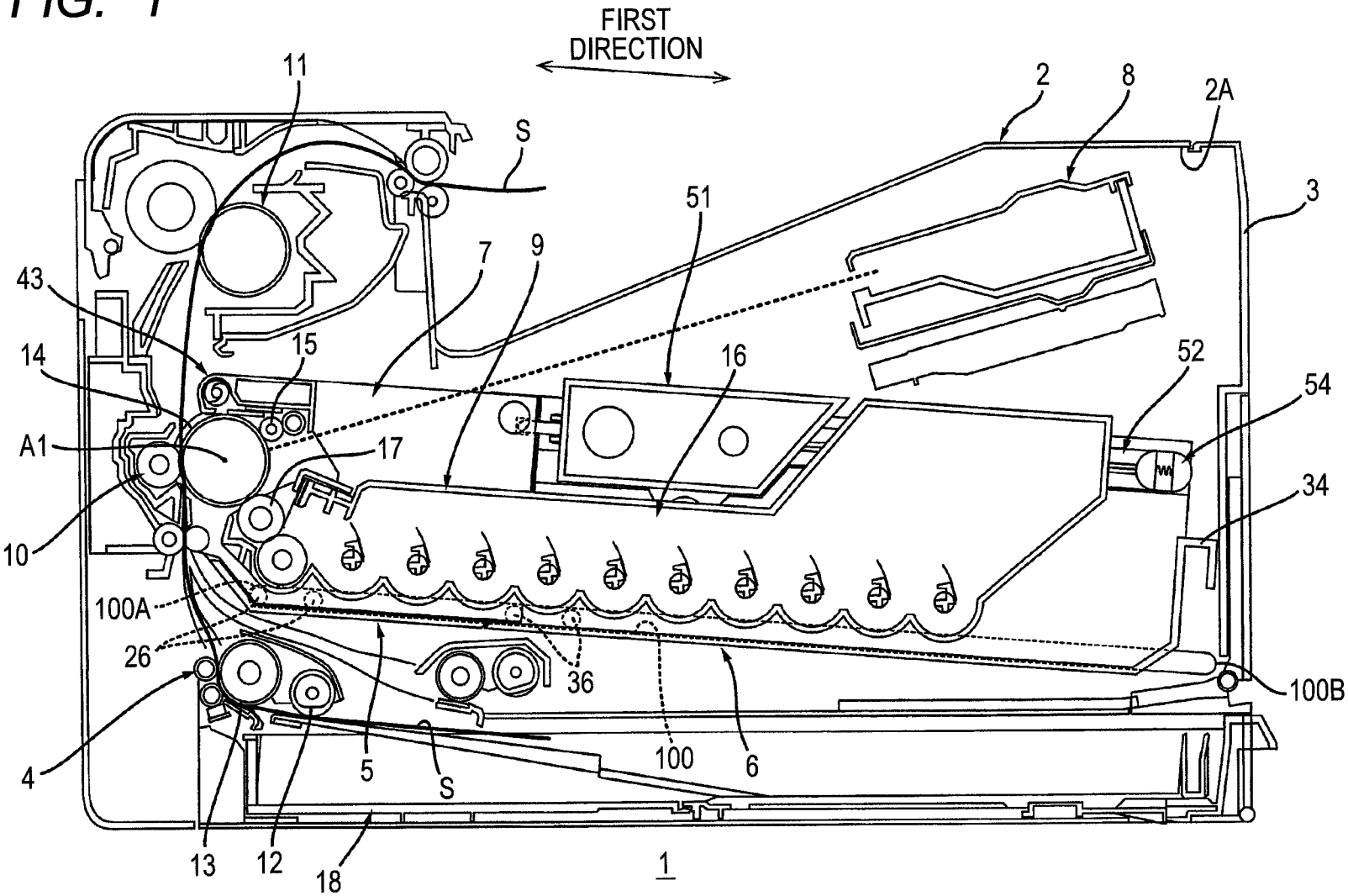
FIG. 1 is a schematic diagram showing an image forming apparatus.

As shown in FIG. 1, the image forming apparatus 1 includes a housing 2, a cover 3, a sheet feeder 4, a first drawer 5, a second drawer 6, a drum cartridge 7, an exposure device 8, a development cartridge 9, a transfer roller 10, and a fixing device 11. Here, the image forming apparatus 1 is dedicated to monochromatic printing. Thus, the image forming apparatus 1 includes one drum cartridge 7 and one development cartridge 9.

1.1 Housing 2 and Cover 3

The housing 2 accommodates the sheet feeder 4, the first drawer 5, the second drawer 6, the drum cartridge 7, the exposure device 8, the development cartridge 9, the transfer roller 10, and the fixing device 11. The housing 2 has an opening 2A.

The cover 3 is attached to the housing 2. The cover 3 is configured to move between a closed position (see FIG. 1) and an open position (see FIG. 2). In a state where the cover 3 is located at the closed position, the cover 3 closes the opening 2A. In a state where the cover 3 is located at the open position, the opening 2A is opened.

1.2 Sheet Feeder 4

The sheet feeder 4 includes a sheet feed cassette 18, a pickup roller 12, and a sheet feed roller 13. The sheet feed cassette 18 stores sheets S. The pickup roller 12 conveys a sheet S within the sheet feed cassette 18 toward the sheet feed roller 13. The sheet feed roller 13 conveys the sheet S from the pickup roller 12 toward the transfer roller 10.

1.3 First Drawer 5

The first drawer 5 supports the drum cartridge 7. The first drawer 5 is configured to move in a first direction between a first mount position (see FIG. 1) and a first detachment position (see FIG. 2). The first direction intersects a vertical direction. The first drawer 5 moves between the first mount position and the first detachment position within the housing 2. Although this will be described later in detail, in a state where the first drawer 5 and the second drawer 6 are locked together, the first drawer 5 is configured to move between the first mount position and the first detachment position. In a state where the first drawer 5 is located at the first mount position, the drum cartridge 7 is mounted on the image forming apparatus 1. In a state where the first drawer 5 is located at the first detachment position, the drum cartridge 7 can be detached from the first drawer 5.

1.4 Second Drawer 6

The second drawer 6 supports the development cartridge 9. The second drawer 6 is configured to move in the first direction between a second mount position (see FIG. 1) and a second detachment position (see FIG. 2). The second drawer 6 moves between the second mount position and the second detachment position through the opening 2A. In a state where the second drawer 6 is located at the second mount position, an entirety of the second drawer 6 is located within the housing 2. In a state where the second drawer 6 is located at the second mount position, the development cartridge 9 is mounted on the image forming apparatus 1. In a state where the second drawer 6 is located at the second mount position, the second drawer 6 is located, in the first direction, between the first drawer 5 at the first mount position and the cover 3 at the closed position. In a state where the second drawer 6 is located at the second mount position, the second drawer 6 overlaps the first drawer 5 located at the first mount position as viewed from the first direction. Further, in a state where the second drawer 6 is located at the second mount position, the second drawer 6 overlaps the cover 3 located at the closed position as viewed from the first direction. In a state where the second drawer 6 is located at the second detachment position, at least part of the second drawer 6 is located outside the housing 2. In a state where the second drawer 6 is located at the second detachment position, the development cartridge 9 can be detached from the second drawer 6.

1.5 Drum Cartridge 7

The drum cartridge 7 includes a photosensitive drum 14 and a charging roller 15.

The photosensitive drum 14 is configured to rotate about an axis A1 extending in the axial direction. The axial direction intersects both the first direction and the vertical direction. Preferably, the axial direction is perpendicular to both the first direction and the vertical direction. The photosensitive drum 14 extends in the axial direction. The photosensitive drum 14 has a cylindrical shape.

The charging roller 15 charges the circumferential surface of the photosensitive drum 14. The charging roller 15 contacts the circumferential surface of the photosensitive drum 14. Alternatively, the drum cartridge 7 may include a Scorotron charger instead of the charging roller 15.

1.6 Exposure Device 8

The exposure device 8 exposes the circumferential surface of the photosensitive drum 14 charged by the charging roller 15. Due to this operation, a latent image is formed on the circumferential surface of the photosensitive drum 14. Specifically, the exposure device 8 is a laser scan unit.

1.7 Development Cartridge 9

The development cartridge 9 includes a toner container 16.

The toner container 16 stores toner that is supplied to the photosensitive drum 14. The toner container 16 includes the development roller 17. That is, the development cartridge 9 includes the development roller 17.

In a state where the first drawer 5 supporting the drum cartridge 7 is located at the first mount position and the second drawer 6 supporting the development cartridge 9 is located at the second mount position, the development roller 17 contacts the photosensitive drum 14. In a state where the first drawer 5 supporting the drum cartridge 7 is located at the first mount position and the second drawer 6 supporting the development cartridge 9 is located at the second mount position, the development roller 17 is configured to supply toner within the toner container 16 to the photosensitive drum 14. Due to this configuration, the latent image formed on the photosensitive drum 14 is developed, and a toner image is formed on the circumferential surface of the photosensitive drum 14.

1.8 Transfer Roller 10

In a state where the drum cartridge 7 is mounted on the first drawer 5 and the first drawer 5 is located at the first mount position, the transfer roller 10 contacts the photosensitive drum 14. The sheet S fed from the sheet feed cassette 18 passes between the transfer roller 10 and the photosensitive drum 14. At this time, the transfer roller 10 transfers the toner image formed on the circumferential surface of the photosensitive drum 14 onto the sheet S.

1.9 Fixing Device 11

The fixing device 11 applies heat and pressure to the sheet S on which the toner image has been transferred, thereby fixing, onto the sheet S, the toner image transferred onto the sheet S from the photosensitive drum 14. The sheet S having passed the fixing device 11 is discharged onto the upper surface of the housing 2.

2. Details of First Drawer 5

Next, details of the first drawer 5 will be described while referring to FIGS. 3 and 4.

Figure 3:
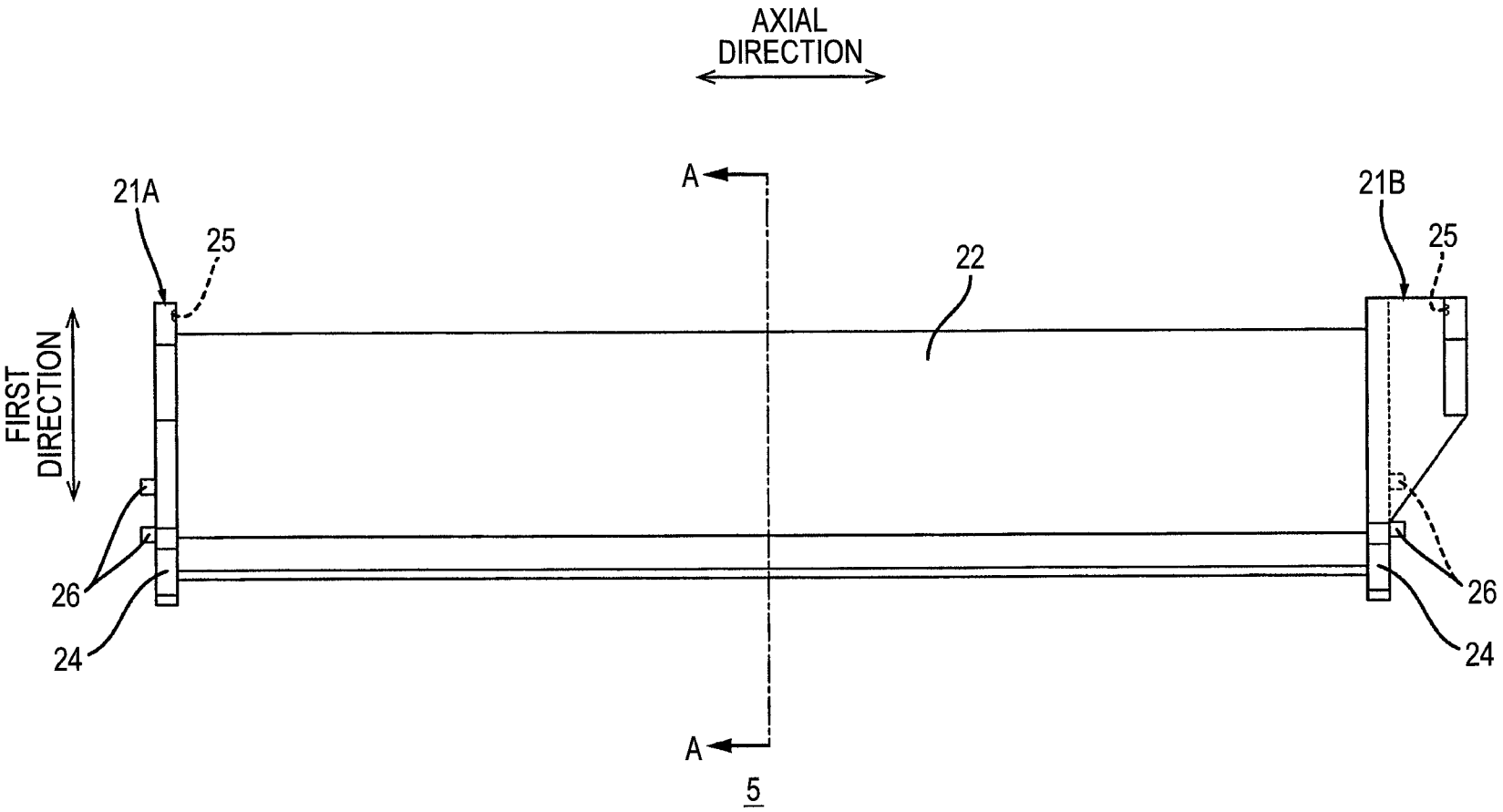
FIG. 3 is a plan view of the first drawer.
Figure 4:
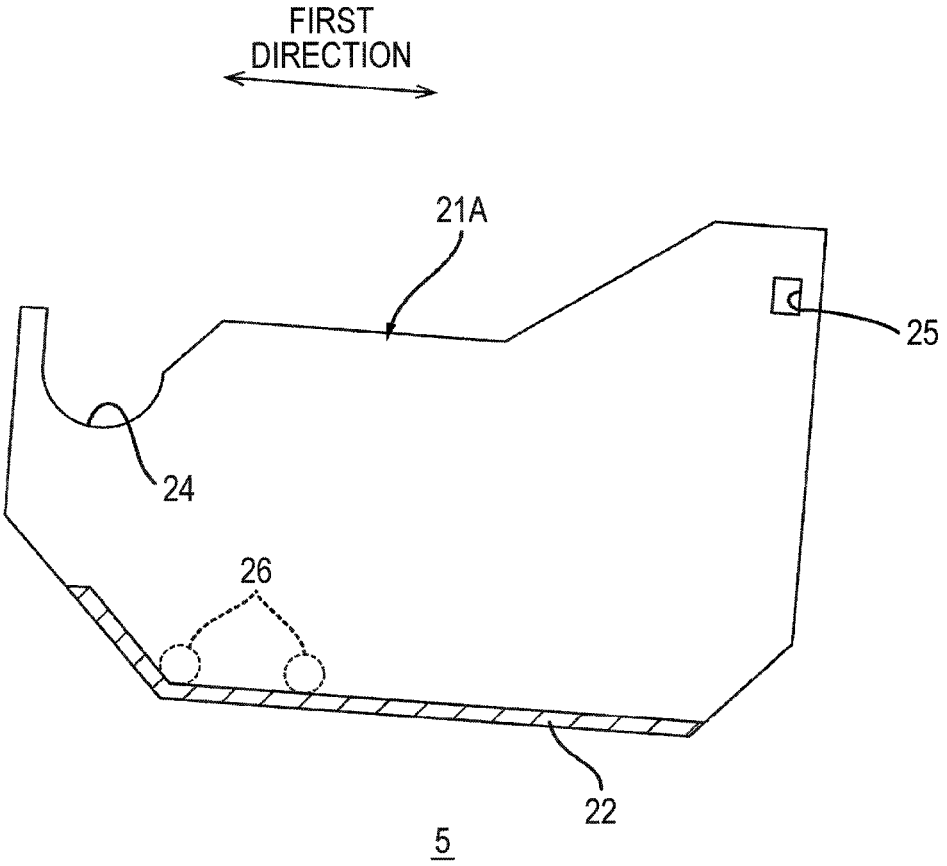
FIG. 4 is a cross-sectional view of the first drawer taken along a line A-A in FIG. 3.

As shown in FIG. 3, the first drawer 5 extends in the axial direction. The first drawer 5 includes two side plates 21A, 21B and a bottom plate 22.

2.1 Side Plates 21A, 21B

The side plate 21A is located at one end portion of the first drawer 5 in the axial direction. The side plate 21A extends in the first direction. As shown in FIG. 4, the side plate 21A has a cutout 24 and a concave portion 25. That is, the first drawer 5 has the cutout 24 and the concave portion 25.

In a state where the drum cartridge 7 is mounted on the first drawer 5, an end portion of the photosensitive drum 14 fits in the cutout 24. Specifically, in a state where the drum cartridge 7 is mounted on the first drawer 5, a drum coupling 42 (see FIG. 8) fits in the cutout 24. The drum coupling 42 will be described later.

In a state where the first drawer 5 is located at the first mount position and the second drawer 6 is located at the second mount position, a claw 332 (see FIG. 12A) of a lock member 33A of the second drawer 6 engages the concave portion 25. The lock member 33A will be described later.

As shown in FIG. 3, the side plate 21A includes first guided portions 26. That is, the first drawer 5 includes the first guided portions 26.

Figure 2:
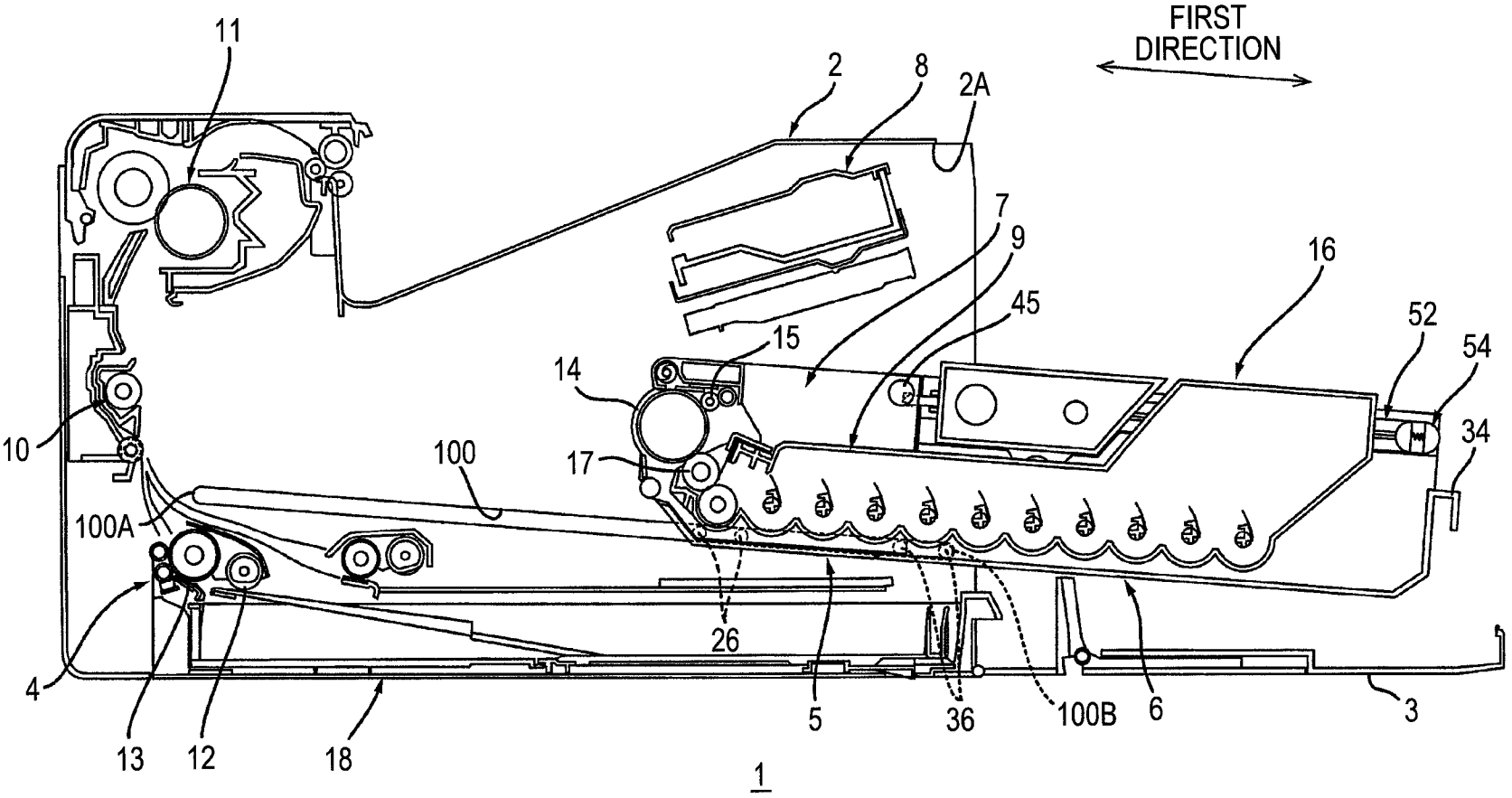
FIG. 2 shows a state where a first drawer shown in FIG. 1 is located at a first detachment position and a second drawer is located at a second detachment position.

The first guided portions 26 are guided by a main guide 100 (see FIG. 2). Specifically, as shown in FIG. 2, the image forming apparatus 1 includes the main guide 100. The main guide 100 is provided within the housing 2. The main guide 100 extends in the first direction. The main guide 100 has one end 100A and an other end 100B in the first direction. The other end 100B is located between the one end 100A and the cover 3 in the first direction. The first guided portions 26 fit in the main guide 100. As shown in FIG. 1, due to contact of the first guided portion 26 with the one end 100A of the main guide 100, the first drawer 5 is located at the first mount position. By locking the second drawer 6 and the first drawer 5 located at the first mount position together, the second drawer 6 is located at the second mount position. In a state where the first drawer 5 is located at the first mount position and the second drawer 6 is located at the second mount position, the distance between second guided portions 36 of the second drawer 6 and the cover 3 at the closed position in the first direction is shorter than the distance between the first guided portions 26 of the first drawer 5 and the cover 3 at the closed position in the first direction. As shown in FIG. 3, the first guided portions 26 protrude in the axial direction. The first guided portions 26 are bosses. The first guided portions 26 have a columnar shape. The main guide 100 (see FIG. 2) is a groove. The main guide 100 is concave in the axial direction.

As shown in FIG. 3, the side plate 21B is located at an other end portion of the first drawer 5 in the axial direction. The side plate 21B is located away from the side plate 21A in the axial direction. The side plate 21B extends in the first direction. As in the side plate 21A, the side plate 21B has a cutout 24 and a concave portion 25, and includes first guided portions 26.

2.2 Bottom Plate 22

As shown in FIG. 3, the bottom plate 22 is located between the side plate 21A and the side plate 21B in the axial direction. The bottom plate 22 extends in the axial direction. One end of the bottom plate 22 in the axial direction connects to the side plate 21A. The other end of the bottom plate 22 in the axial direction connects to the side plate 21B.

3. Details of Second Drawer 6

Next, details of the second drawer 6 will be described while referring to FIGS. 5 to 7, 12A, and 12B.

Figure 5:
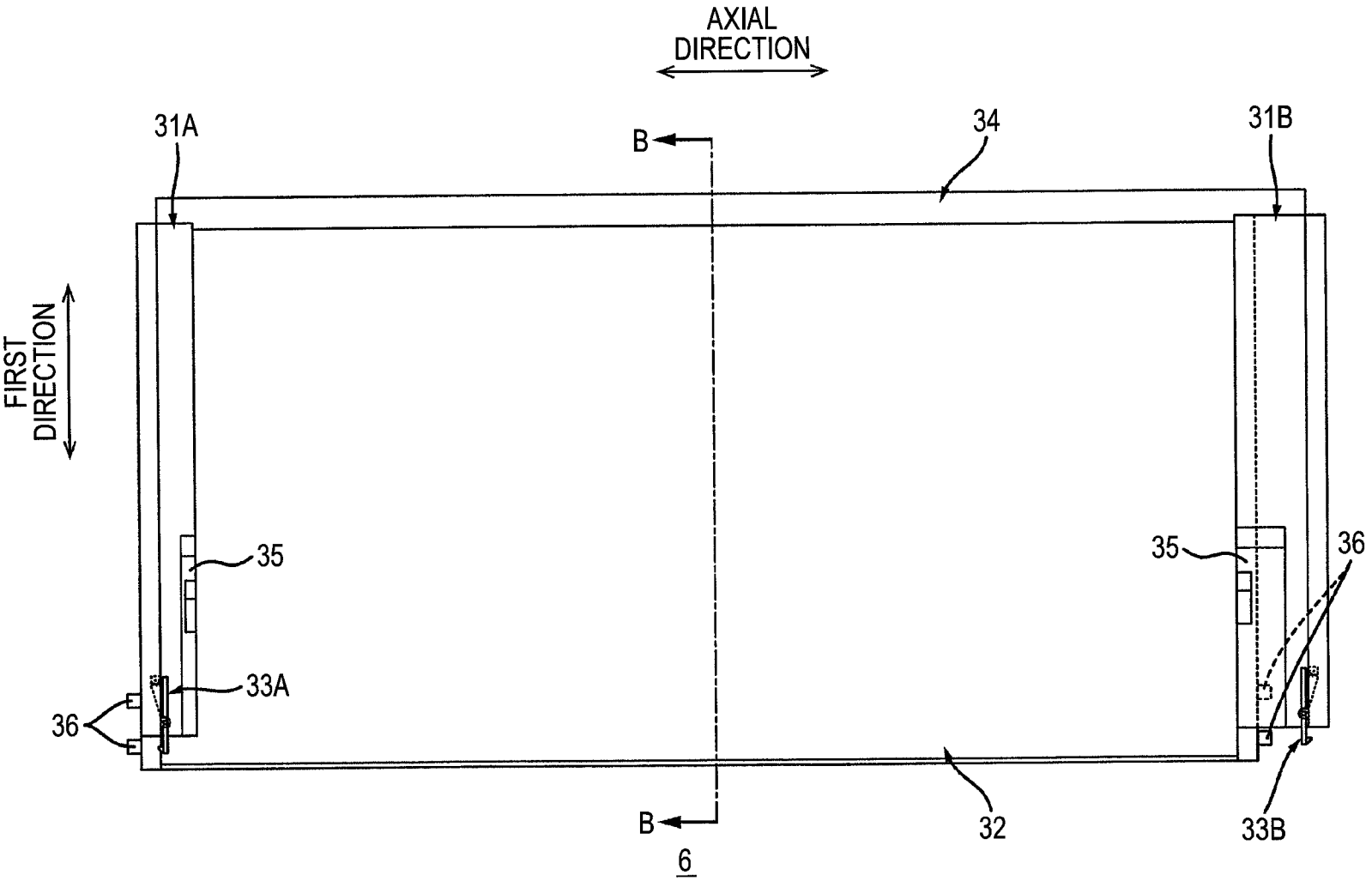
FIG. 5 is a plan view of the second drawer.

As shown in FIG. 5, the second drawer 6 extends in the axial direction. The second drawer 6 includes two side plates 31A, 31B, a bottom plate 32, two lock members 33A, 33B, and a grip 34. That is, the image forming apparatus 1 includes the lock members 33A, 33B.

3.1 Side Plates 31A, 31B

Figure 6:
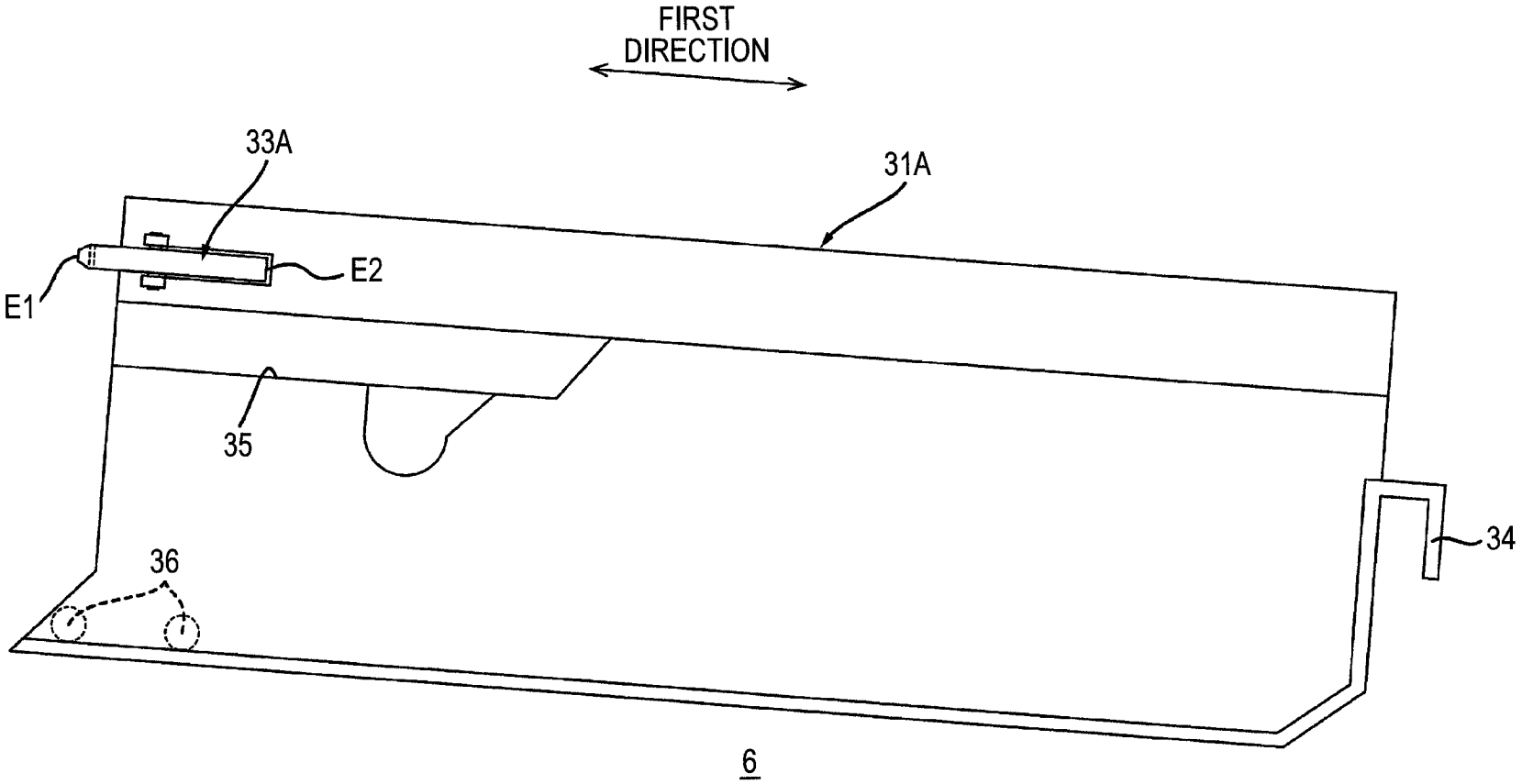
FIG. 6 is a cross-sectional view of the second drawer taken along a line B-B in FIG. 5.

The side plate 31A is located at one end portion of the second drawer 6 in the axial direction. The side plate 31A extends in the first direction. As shown in FIG. 6, the side plate 31A has a concave portion 35.

In a state where the development cartridge 9 is supported by the second drawer 6, a waste-toner container 51 (see FIG. 1) of the development cartridge 9 fits in the concave portion 35. With this configuration, in a state where the development cartridge 9 is supported by the second drawer 6, the waste-toner container 51 is fixed relative to the second drawer 6. The waste-toner container 51 will be described later.

As shown in FIG. 5, the side plate 31A includes the second guided portions 36. That is, the second drawer 6 includes the second guided portions 36.

The second guided portions 36 are guided by the main guide 100 (see FIG. 2). That is, the main guide 100 guides both the first guided portions 26 of the first drawer 5 and the second guided portions 36 of the second drawer 6. Specifically, as shown in FIG. 2, the second guided portions 36 fit in the main guide 100. The second guided portion 36 contacts the other end 100B of the main guide 100, thereby the second drawer 6 is located at the second detachment position. The second drawer 6 is located at the second detachment position in a state where the first drawer 5 and the second drawer 6 are locked together, thereby the first drawer 5 is located at the first detachment position. As shown in FIG. 5, the second guided portions 36 protrude in the axial direction. The second guided portions 36 are bosses. The second guided portions 36 have a cylindrical shape.

As shown in FIG. 5, the side plate 31B is located at an other end portion of the second drawer 6 in the axial direction. The side plate 31B is located away from the side plate 31A in the axial direction. The side plate 31B extends in the first direction. As in the side plate 31A, the side plate 31B has a concave portion 35, and includes second guided portions 36.

3.2 Bottom Plate 32

As shown in FIG. 5, the bottom plate 32 is located between the side plate 31A and the side plate 31B in the axial direction. The bottom plate 32 extends in the axial direction. One end of the bottom plate 32 in the axial direction connects to the side plate 31A. The other end of the bottom plate 32 in the axial direction connects to the side plate 31B.

3.3 Lock Members 33A, 33B

As shown in FIGS. 5 and 6, the lock member 33A is attached to the side plate 31A. The lock member 33A is configured to move between a lock position (see FIG. 12A) and a lock release position (see FIG. 12B). In a state where the lock member 33A is located at the lock position, the lock member 33A locks the first drawer 5 and the second drawer 6 together. In a state where the lock member 33A is located at the lock release position, a lock state between the first drawer 5 and the second drawer 6 is released.

Figure 12A:
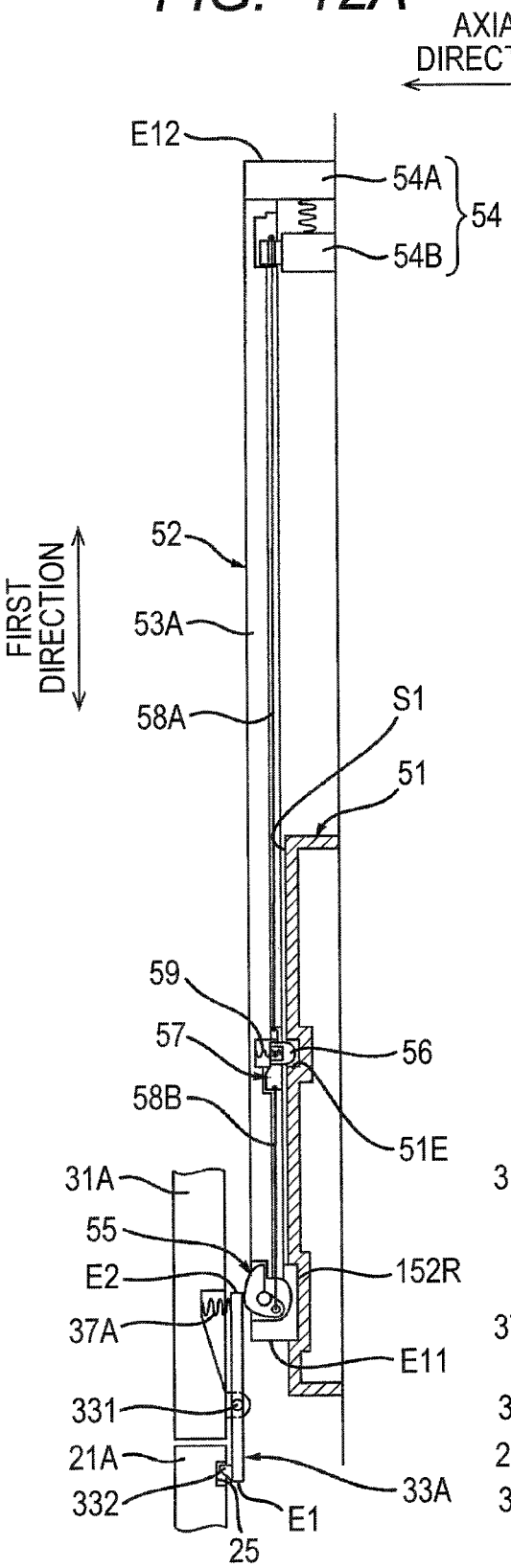
FIG. 12A is an explanatory diagram for illustrating the lock release member in detail and showing a state where an operation portion is located at a separation position, a cam is located at a first position, and a lock member is located at a lock position.

Specifically, as shown in FIG. 6, the lock member 33A extends in a particular direction. In this embodiment, the lock member 33A extends in the first direction. The lock member 33A has a first end portion E1 and a second end portion E2 in a direction in which the lock member 33A extends. The second end portion E2 is located away from the first end portion E1 in the direction in which the lock member 33A extends. As shown in FIG. 12A, the lock member 33A includes a shaft 331 and the claw 332.

The shaft 331 is located between the first end portion E1 and the second end portion E2 in the direction in which the lock member 33A extends. The shaft 331 extends in a direction intersecting the direction in which the lock member 33A extends. Preferably, the shaft 331 extends in a direction perpendicular to the direction in which the lock member 33A extends. The shaft 331 is rotatably supported by the side plate 31A. With this configuration, the lock member 33A is configured to rotatably move about the shaft 331 between the lock position and the lock release position.

Figure 7:
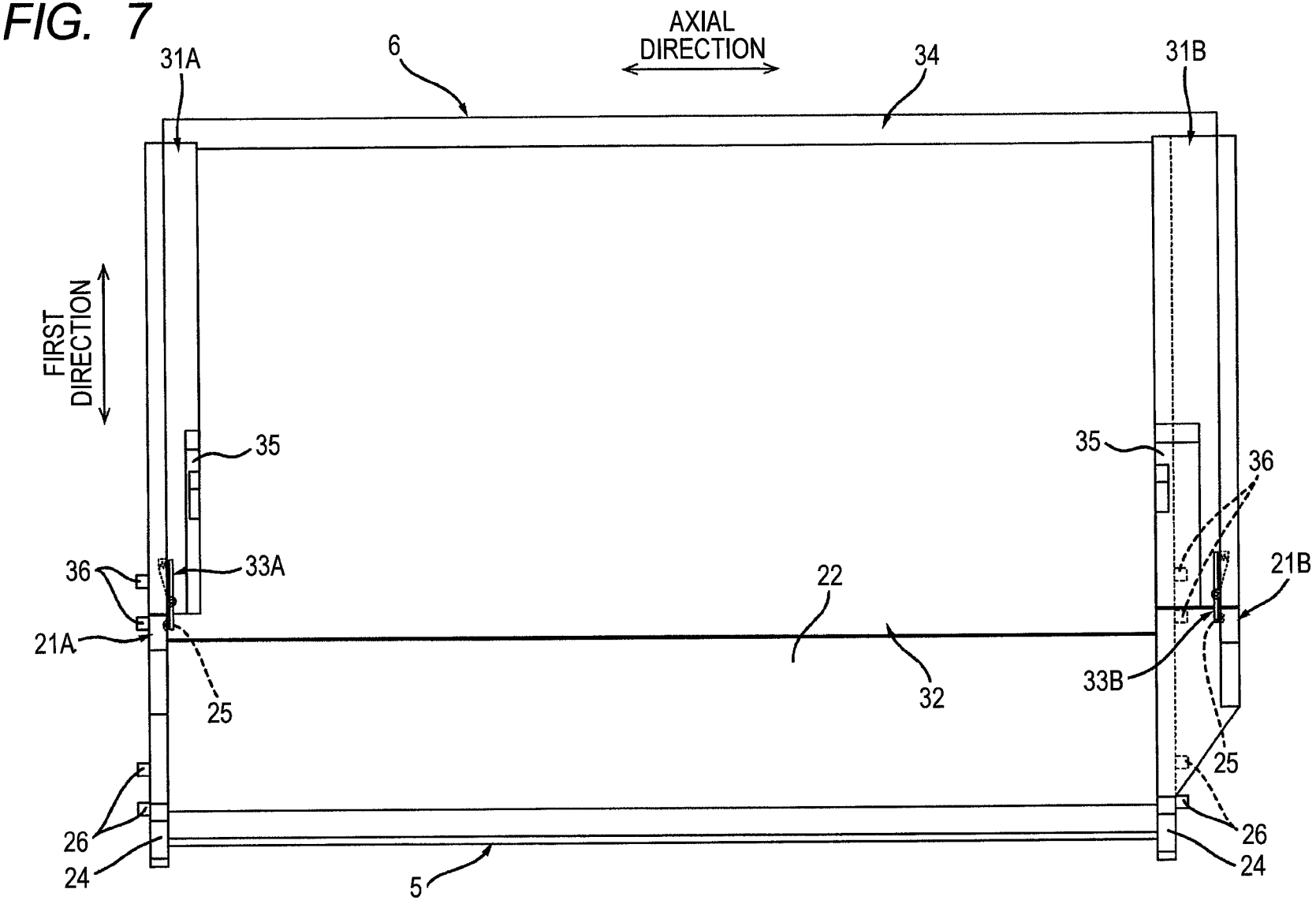
FIG. 7 is a plan view of the first drawer and the second drawer in a state where the first drawer and the second drawer are locked together.

The claw 332 is located at the first end portion E1 of the lock member 33A. In a state where the first drawer 5 is located at the first mount position and the second drawer 6 is located at the second mount position (see FIG. 1), the claw 332 engages the concave portion 25 of the first drawer 5. With this configuration, as shown in FIG. 7, the first drawer 5 and the second drawer 6 are fixed to each other so that the first drawer 5 and the second drawer 6 do not separate from each other in the first direction. That is, in a state where the first drawer 5 is located at the first mount position and the second drawer 6 is located at the second mount position, the first drawer 5 and the second drawer 6 are locked together. In this state, the first drawer 5 is configured to move between the first mount position (see FIG. 1) and the first detachment position (see FIG. 2) together with the second drawer 6.

Figure 12B:
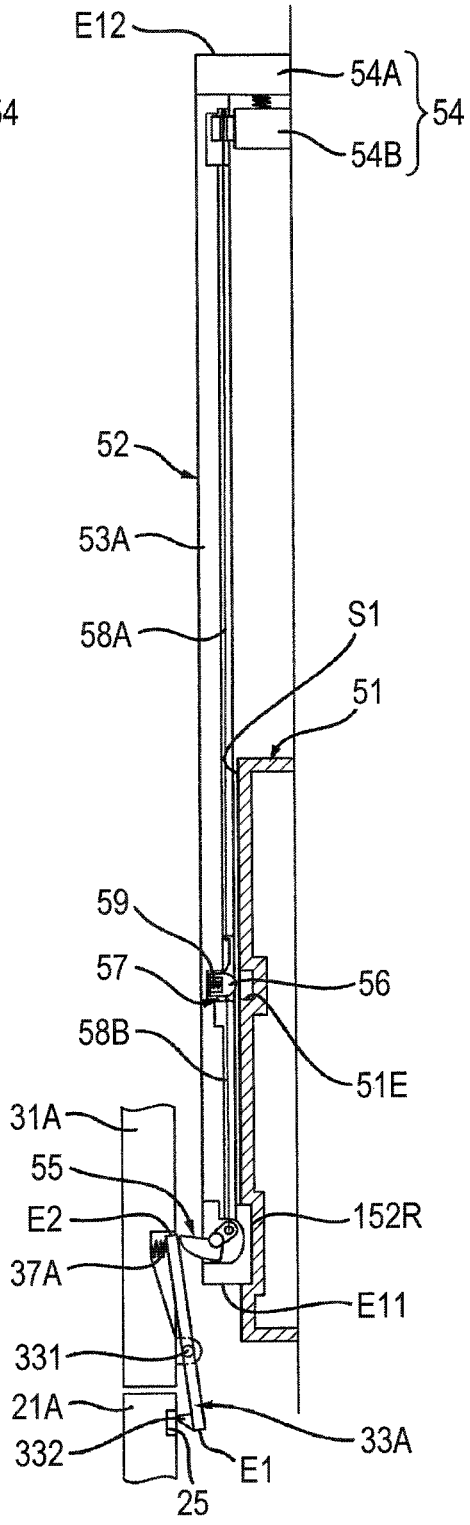
FIG. 12B is an explanatory diagram for illustrating the lock release member in detail, together with FIG. 12A, and showing a state where the operation portion is located at an adjacent position, the cam is located at a second position, and the lock member is located at a lock release position.

As shown in FIG. 12A, the second drawer 6 includes a spring 37A. The spring 37A is located between the side plate 31A and the second end portion E2 of the lock member 33A. As shown in FIG. 12B, the spring 37A presses the lock member 33A located at the lock release position toward the lock position.

As shown in FIG. 5, a lock member 33B is attached to the side plate 31B. The lock member 33B has the same configuration as the lock member 33A, and descriptions thereof are omitted.

3.4 Grip 34

The grip 34 is gripped by the user for moving the second drawer 6. The grip 34 is located away from the lock member 33A in the first direction. In a state where the first drawer 5 and the second drawer 6 are locked together, the grip 34 is located at an opposite side from the first drawer 5 with respect to the lock member 33A in the first direction.

4. Details of Drum Cartridge 7

Next, details of the drum cartridge 7 will be described while referring to FIGS. 8 to 9B.

Figure 8:
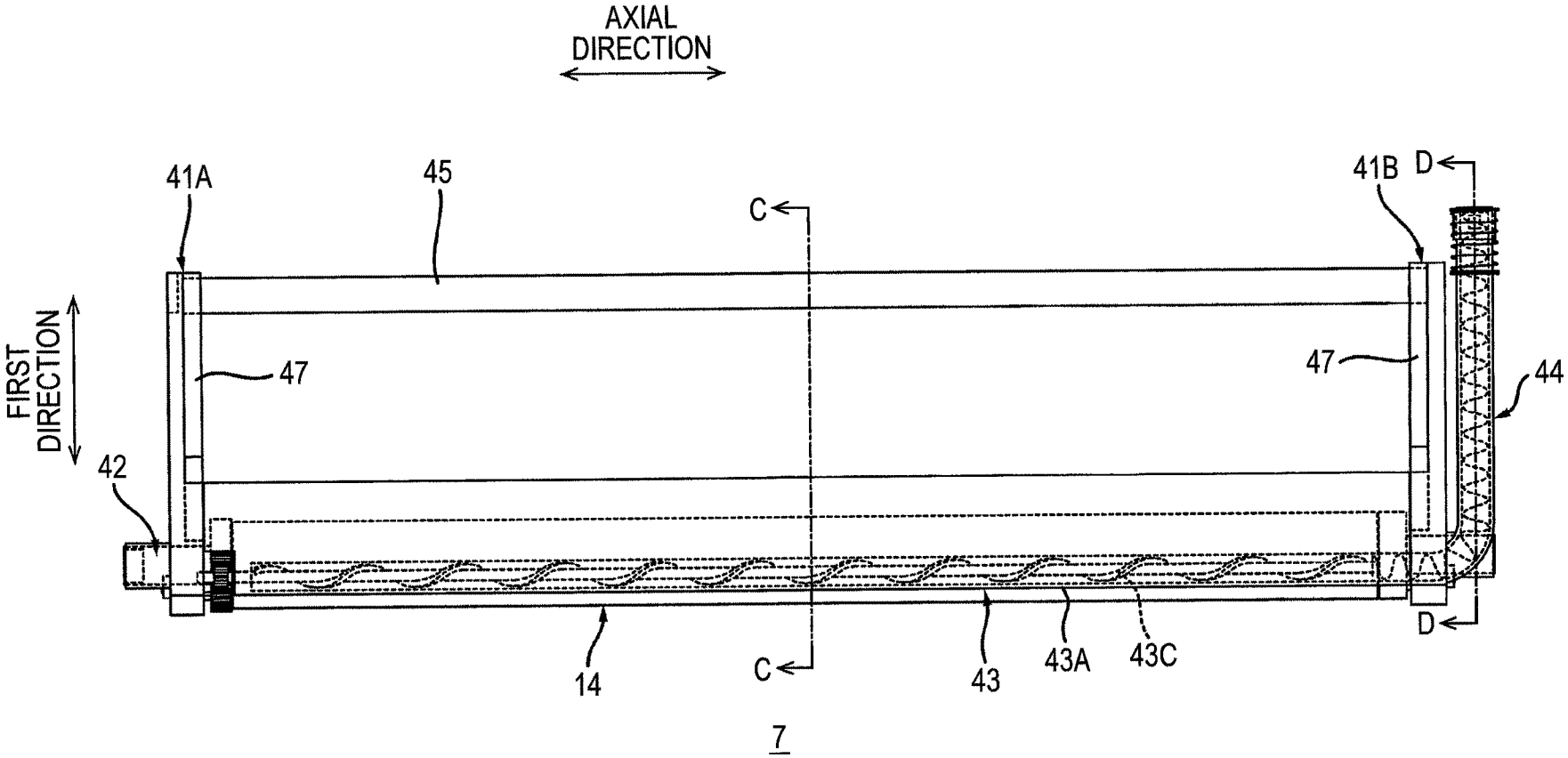
FIG. 8 is a plan view of a drum cartridge.

As shown in FIG. 8, the drum cartridge 7 extends in the axial direction. The drum cartridge 7 includes two side plates 41A, 41B, a drum coupling 42, a drum cleaner 43, a waste-toner conveyance pipe 44, and a grip 45, in addition to the above-described photosensitive drum 14 and the charging roller 15.

4.1 Side Plates 41A, 41B

Figure 9A:
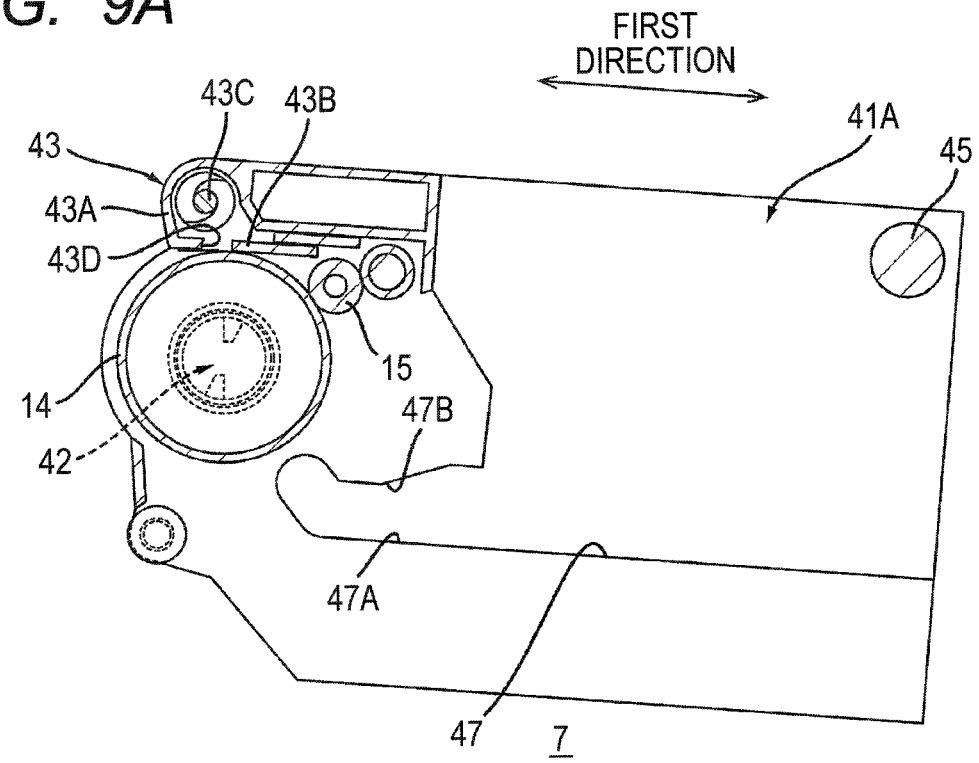
FIG. 9A is a cross-sectional view of the drum cartridge taken along a line C-C in FIG. 8.
Figure 9B:
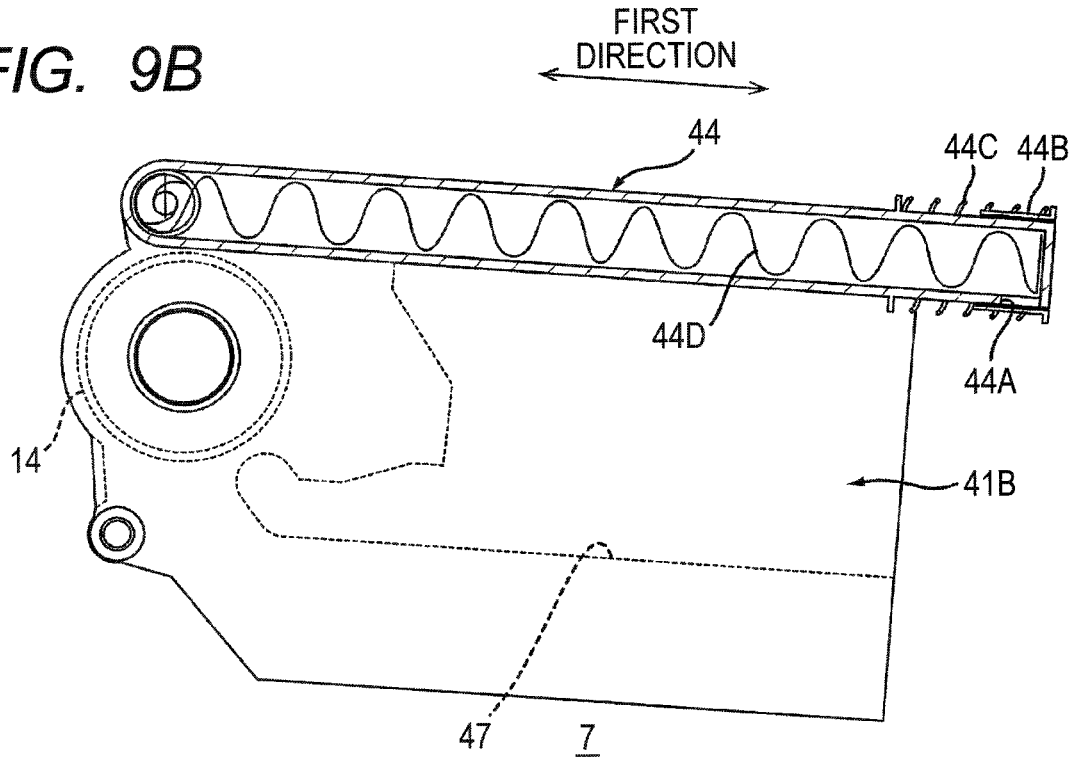
FIG. 9B is a cross-sectional view of the drum cartridge taken along a line D-D in FIG. 8.

As shown in FIG. 8, the side plate 41A is located at one end portion of the drum cartridge 7 in the axial direction. The side plate 41A extends in the first direction. As shown in FIG. 9A, the side plate 41A has a guide 47. That is, the drum cartridge 7 has the guide 47.

When the development cartridge 9 is mounted onto the second drawer 6 in a state where the first drawer 5 supporting the drum cartridge 7 is located at the first detachment position and the second drawer 6 is located at the second detachment position (see FIG. 2), the guide 47 guides the development roller 17 toward the photosensitive drum 14. The guide 47 is located below the grip 45. The guide 47 extends toward the photosensitive drum 14. In this embodiment, the guide 47 extends in the first direction. Specifically, the guide 47 is a groove. The guide 47 has a first guide surface 47A and a second guide surface 47B. The first guide surface 47A and the second guide surface 47B are inner surfaces of the guide 47. The second guide surface 47B faces the first guide surface 47A with a space therebetween in a direction intersecting the direction in which the guide 47 extends. When the development cartridge 9 is mounted onto the second drawer 6, an end portion of a shaft of the development roller 17 fits in the guide 47. Specifically, in a state where the end portion of the shaft of the development roller 17 fits in the guide 47, the end portion of the shaft of the development roller 17 is located between the first guide surface 47A and the second guide surface 47B. That is, the guide 47 guides the shaft of the development roller 17, thereby guiding the development roller 17 toward the photosensitive drum 14. Further, by sandwiching the shaft of the development roller 17 with the first guide surface 47A and the second guide surface 47B, the guide 47 fixes the position of the development roller 17 relative to the photosensitive drum 14.

As shown in FIG. 8, the side plate 41B is located at the other end portion of the drum cartridge 7 in the axial direction. The side plate 41B is located away from the side plate 41A in the axial direction. The side plate 41B extends in the first direction. As in the side plate 41A, the side plate 41B has a guide 47.

4.2 Drum Coupling 42

As shown in FIG. 8, the drum coupling 42 is attached to one end portion of the photosensitive drum 14 in the axial direction. The drum coupling 42 is configured to rotate together with the photosensitive drum 14. The drum coupling 42 is rotatably supported by the side plate 41A. In a state where the drum cartridge 7 is mounted on the first drawer 5, the drum coupling 42 fits in the cutout 24 (see FIG. 4). In a state where the drum cartridge 7 is mounted on the first drawer 5 and the first drawer 5 is located at the first mount position, a main coupling (not shown) provided in the housing 2 engages the drum coupling 42. In a state where the main coupling engages the drum coupling 42, the drum coupling 42 is configured to rotate together with the main coupling. With this configuration, the drum coupling 42 receives power from the main coupling and causes the photosensitive drum 14 to rotate.

4.3 Drum Cleaner 43

As shown in FIG. 9A, the drum cleaner 43 is located above the photosensitive drum 14 in a state where the drum cartridge 7 is mounted on the first drawer 5. The drum cleaner 43 includes a cleaner frame 43A, a cleaning member 43B, and an auger screw 43C.

As shown in FIG. 8, the cleaner frame 43A is located between the side plate 41A and the side plate 41B in the axial direction. The cleaner frame 43A extends in the axial direction. One end of the cleaner frame 43A in the axial direction connects to the side plate 41A. The other end of the cleaner frame 43A in the axial direction connects to the side plate 41B. As shown in FIG. 9A, the cleaner frame 43A has an opening 43D. The opening 43D communicates with the internal space of the cleaner frame 43A.

The cleaning member 43B is attached to the cleaner frame 43A. The cleaning member 43B extends in the axial direction, and has a plate shape. An edge of the cleaning member 43B is located within the opening 43D. The edge of the cleaning member 43B contacts the circumferential surface of the photosensitive drum 14. With this configuration, when the photosensitive drum 14 rotates, toner adhering to the circumferential surface of the photosensitive drum 14 is scraped off by the edge of the cleaning member 43B, and moves into the cleaner frame 43A through the opening 43D. With this configuration, the drum cleaner 43 cleans the circumferential surface of the photosensitive drum 14. The toner removed from the circumferential surface of the photosensitive drum 14 by the drum cleaner 43 is referred to as "waste toner".

As shown in FIG. 8, the auger screw 43C is located within the cleaner frame 43A. The auger screw 43C extends in the axial direction. The auger screw 43C conveys waste toner stored in the cleaner frame 43A toward the waste-toner conveyance pipe 44.

4.4 Waste-Toner Conveyance Pipe 44

As shown in FIG. 8, the waste-toner conveyance pipe 44 is attached to the side plate 41B. The waste-toner conveyance pipe 44 is used for conveying waste toner from the drum cleaner 43 to the waste-toner container 51 (see FIG. 1). The internal space of the waste-toner conveyance pipe 44 communicates with the internal space of the cleaner frame 43A. As shown in FIG. 9B, the waste-toner conveyance pipe 44 has a discharge port 44A. The waste-toner conveyance pipe 44 includes a shutter 44B, a spring 44C, and a shaftless screw 44D.

The discharge port 44A is located at an end portion of the waste-toner conveyance pipe 44. The discharge port 44A communicates with the internal space of the waste-toner conveyance pipe 44. The discharge port 44A is configured to discharge waste toner within the waste-toner conveyance pipe 44.

The shutter 44B is located at an end portion of the waste-toner conveyance pipe 44. The shutter 44B is configured to move between the closed position (see FIG. 9B) and the open position (not shown). In a case where the shutter 44B is located at the closed position, the shutter 44B closes the discharge port 44A. In a case where the shutter 44B is located at the open position, the discharge port 44A is opened.

The spring 44C is located at the outer circumferential surface of the waste-toner conveyance pipe 44. The spring 44C presses the shutter 44B located at the open position toward the closed position.

The shaftless screw 44D is located within the waste-toner conveyance pipe 44. The shaftless screw 44D extends along the waste-toner conveyance pipe 44. One end of the shaftless screw 44D is coupled to the auger screw 43C, and the shaftless screw 44D rotates together with the auger screw 43C, thereby conveys toner within the waste-toner conveyance pipe 44 toward the discharge port 44A.

4.5 Grip 45

As shown in FIG. 8, the grip 45 is located between the side plate 41A and the side plate 41B in the axial direction. The grip 45 extends in the axial direction. One end of the grip 45 in the axial direction connects to the side plate 41A. The other end of the grip 45 in the axial direction connects to the side plate 41B. The grip 45 is gripped by the user for detaching the drum cartridge 7 from the first drawer 5. In a state where the first drawer 5 is located at the first detachment position, the drum cartridge 7 can be detached upward. As shown in FIG. 2, in a state where the first drawer 5 supporting the drum cartridge 7 and the second drawer 6 supporting the development cartridge 9 are locked together, the grip 45 is located above the development cartridge 9. Specifically, in a state where the first drawer 5 supporting the drum cartridge 7 and the second drawer 6 supporting the development cartridge 9 are locked together, the grip 45 is located above a part of the development cartridge 9. Here, the grip 45 may be aligned with another part of the development cartridge 9 in the first direction, the other part of the development cartridge 9 being different from the part of the development cartridge 9 located below the grip 45.

5. Details of Development Cartridge 9

Next, details of the development cartridge 9 will be described while referring to FIGS. 10 to 14.

Figure 10:
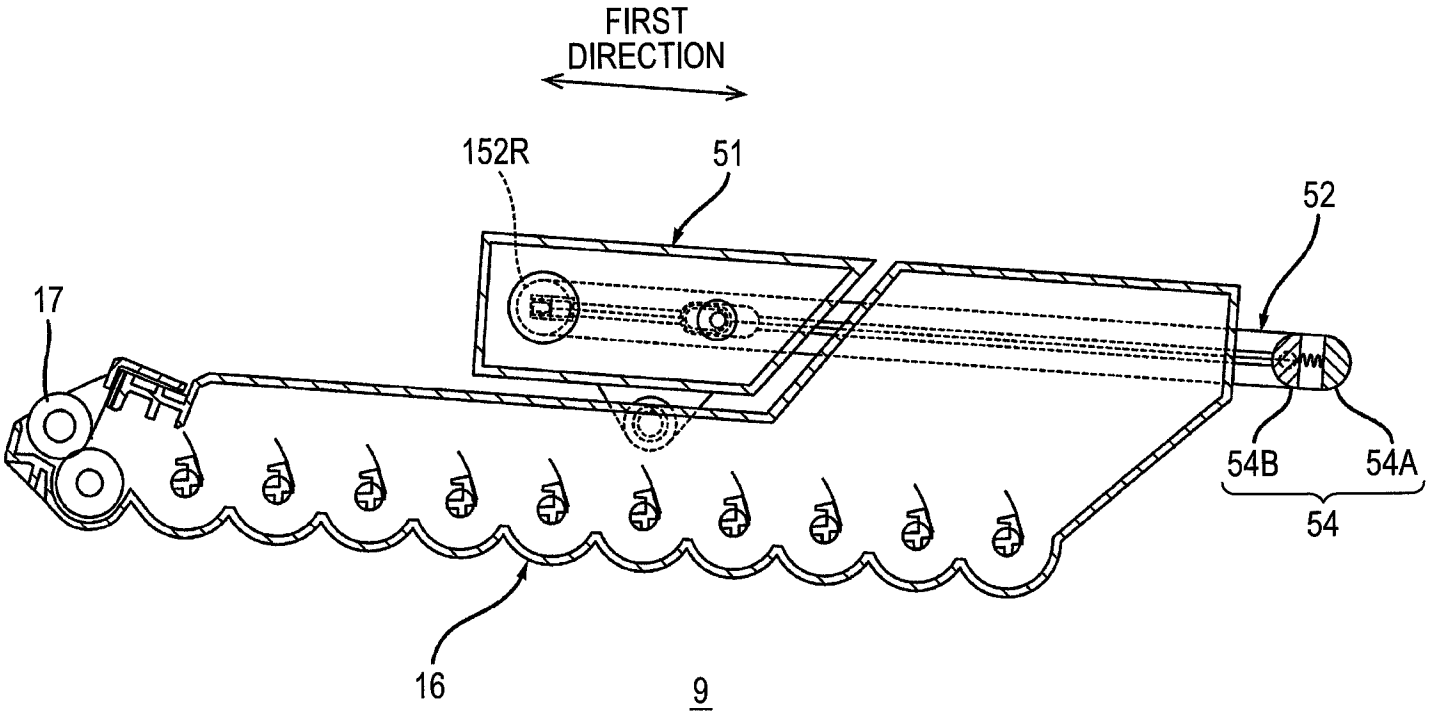
FIG. 10 is a cross-sectional view of a development cartridge.

As shown in FIG. 10, the development cartridge 9 includes the waste-toner container 51 and a lock release member 52 in addition to the above-described toner container 16. That is, the image forming apparatus 1 includes the lock release member 52.

5.1 Waste-Toner Container 51

Figure 11:
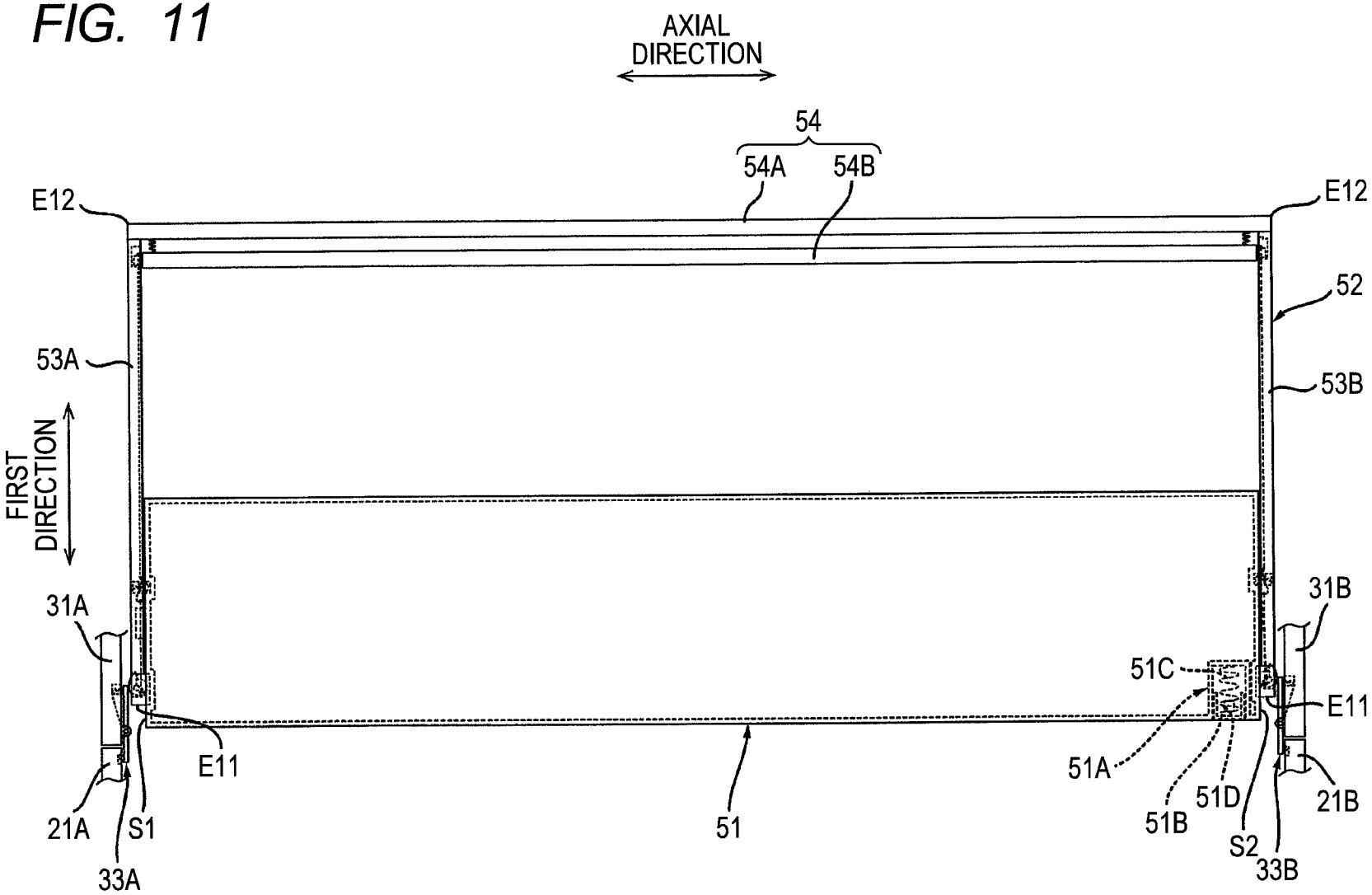
FIG. 11 is a plan view of a waste-toner container and a lock release member shown in FIG. 10.

As shown in FIG. 10, the waste-toner container 51 is attached to an upper surface of the toner container 16. The waste-toner container 51 is configured to swingably move relative to the toner container 16. As shown in FIG. 11, the waste-toner container 51 extends in the axial direction. The waste-toner container 51 has a box shape. The waste-toner container 51 includes a connection portion 51A, a shutter 51B, and a spring 51C.

In a state where the first drawer 5 supporting the drum cartridge 7 and the second drawer 6 supporting the development cartridge 9 are locked together, the waste-toner conveyance pipe 44 (see FIG. 8) of the drum cartridge 7 is connected to the connection portion 51A. That is, in a state where the first drawer 5 supporting the drum cartridge 7 and the second drawer 6 supporting the development cartridge 9 are locked together, the waste-toner conveyance pipe 44 of the drum cartridge 7 is connected to the waste-toner container 51. The connection portion 51A is located within the waste-toner container 51. The connection portion 51A extends in the first direction. The connection portion 51A has a tubular shape. The connection portion 51A has a reception port 51D. The reception port 51D communicates with the internal space of the waste-toner container 51. In a state where the waste-toner conveyance pipe 44 is connected to the connection portion 51A, the reception port 51D communicates with a discharge port 44A (see FIG. 9B) of the waste-toner conveyance pipe 44. With this configuration, in a state where the waste-toner conveyance pipe 44 is connected to the connection portion 51A, waste toner conveyed through the waste-toner conveyance pipe 44 moves into the waste-toner container 51 through the discharge port 44A and the reception port 51D. The waste-toner container 51 stores waste toner.

The shutter 51B is located within the connection portion 51A. The shutter 51B is configured to move between a closed position (see FIG. 11) and an open position (not shown). In a state where the shutter 51B is located at the closed position, the shutter 51B closes the reception port 51D. In a state where the shutter 51B is located at the open position, the reception port 51D is opened.

The spring 51C is located within the connection portion 51A. The spring 51C presses the shutter 51B located at the open position toward the closed position.

5.2 Lock Release Member 52

As shown in FIG. 11, the lock release member 52 is attached to the waste-toner container 51. In a state where the lock release member 52 is not fixed to the waste-toner container 51, the lock release member 52 is configured to rotatably move between a stowed position (see FIG. 10) and a deployed position (see FIG. 14).

As shown in FIG. 10, in a state where the lock release member 52 is located at the stowed position, the lock release member 52 is fixed so as not to rotatably move relative to the waste-toner container 51. In a state where the lock release member 52 is located at the stowed position, the lock release member 52 extends in the first direction. When the development cartridge 9 is mounted on the second drawer 6 in a state where the lock release member 52 is located at the stowed position, a cam 55 (see FIG. 12A) of the lock release member 52 contacts the lock member 33A.

Figure 14:
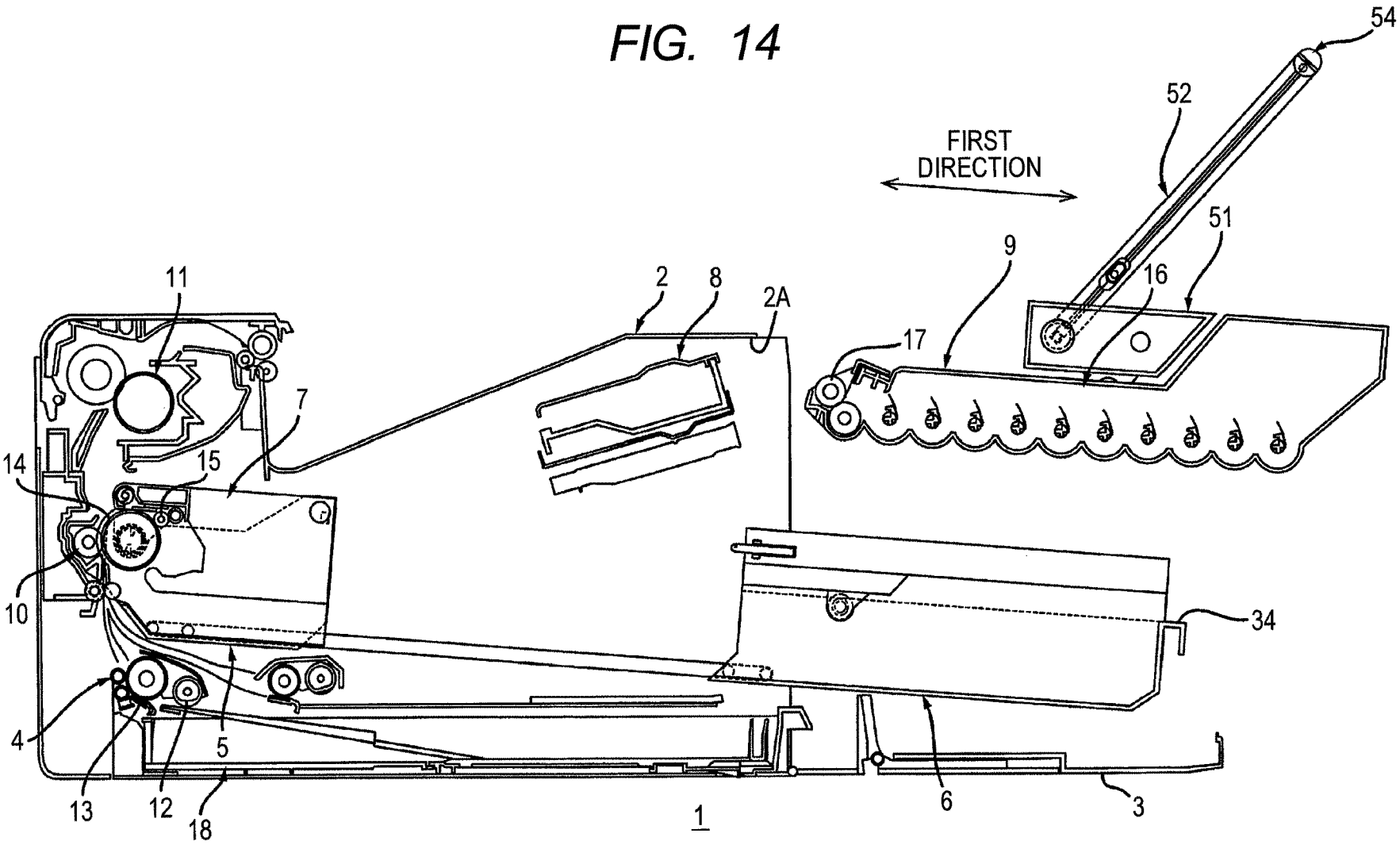
FIG. 14 is an explanatory diagram for illustrating, following FIG. 13, the operation in which the user replaces the development cartridge without replacing the drum cartridge, and showing a state where the development cartridge is detached from the second drawer.

As shown in FIG. 14, in a state where the lock release member 52 is located at the deployed position, the lock release member 52 is not fixed relative to the waste-toner container 51. That is, in a state where the lock release member 52 is located at the deployed position, the lock release member 52 is configured to rotatably move relative to the waste-toner container 51. In a state where the lock release member 52 is located at the deployed position, the lock release member 52 extends upward from the waste-toner container 51. In other words, in a state where the lock release member 52 is located at the deployed position, the lock release member 52 extends in a direction intersecting the first direction. When the development cartridge 9 is mounted on the second drawer 6 in a state where the lock release member 52 is located at the deployed position, the cam 55 of the lock release member 52 does not press the lock member 33A.

As shown in FIG. 11, the lock release member 52 includes two arms 53A, 53B and a grip 54.

5.2.1 Arms 53A, 53B

In a state where the lock release member 52 is located at the stowed position, the arm 53A extends in the first direction. The arm 53A has one end portion E11 and another end portion E12. The one end portion E11 is rotatably attached to one side surface S1 of the waste-toner container 51 in the axial direction. More specifically, as shown in FIGS. 10, 12A, and 12B, the arm 53A is fixed to a cylindrical member 152R, and the cylindrical member 152R is rotatably supported by the waste-toner container 51. This enables the lock release member 52 to rotatably move between the stowed position (see FIG. 10) and the deployed position (see FIG. 14). The other end portion E12 is located away from the one end portion E11. As shown in FIG. 12A, the arm 53A includes the cam 55, a protrusion 56, a cam 57, and two wires 58A, 58B. That is, the lock release member 52 includes the cam 55.

The cam 55 is located at the one end portion E11 of the arm 53A. The cam 55 is configured to move between a first position (see FIG. 12A) and a second position (see FIG. 12B). Specifically, the cam 55 is configured to rotatably move between the first position and the second position. In a state where the cam 55 is located at the first position, the cam 55 does not press the lock member 33A. With this configuration, in a state where the cam 55 is located at the first position, the cam 55 allows the lock member 33A to be located at the lock position. When the cam 55 moves from the first position to the second position, the cam 55 presses the lock member 33A located at the lock position toward the lock release position. In a state where the cam 55 is located at the second position, the cam 55 causes the lock member 33A to be located at the lock release position. With this configuration, the lock release member 52 causes the lock member 33A located at the lock position to move to the lock release position.

The protrusion 56 is located between the one end portion E11 and the other end portion E12 in a direction in which the arm 53A extends. In other words, the protrusion 56 is located away from a rotational axis of the arm 53A. In a state where the lock release member 52 is located at the stowed position, the protrusion 56 fits in a concave portion 51E of the waste-toner container 51. The concave portion 51E is located at one side surface S1 of the waste-toner container 51 in the axial direction. When the protrusion 56 fits in the concave portion ME, the lock release member 52 is fixed so as not to rotatably move relative to the waste-toner container 51. The protrusion 56 is configured to move in the axial direction between a position (see FIG. 12A) at which the protrusion 56 fits in the concave portion ME and a position (see FIG. 12B) at which the protrusion 56 separates from the concave portion ME. When the protrusion 56 separates from the concave portion ME, the lock release member 52 is configured to rotatably move relative to the waste-toner container 51. The protrusion 56 extends in the axial direction. The protrusion 56 has a cylindrical shape. The protrusion 56 is pressed by a spring 59 in a direction from the position at which the protrusion 56 separates from the concave portion ME toward the position at which protrusion 56 fits in the concave portion ME.

The cam 57 is located between the one end portion E11 and the other end portion E12 in the direction in which the arm 53A extends. The cam 57 is configured to move between a pressing position (see FIG. 12B) and a non-pressing position (see FIG. 12A) in the direction in which the arm 53A extends. In a state where the cam 57 is located at the pressing position, the cam 57 presses the protrusion 56 to cause the protrusion 56 to be located at the position where the protrusion 56 separates from the concave portion 51E. In a state where the cam 57 is located at the non-pressing position, the cam 57 stops pressing the protrusion 56 to allow the protrusion 56 to fit in the concave portion ME.

The wire 58A connects an operation portion 54B of the grip 54 with the cam 57. The operation portion 54B will be described later. The wire 58B connects the cam 57 with the cam 55. The wire 58A connects the operation portion 54B with the cam 57 and the wire 58B connects the cam 57 with the cam 55, and thereby the cam 57 and the cam 55 move in conjunction with movement of the operation portion 54B. Specifically, as shown in FIG. 12A, in a state where the cam 57 is located at the non-pressing position, the cam 55 is located at the first position. With this configuration, in a state where the cam 55 is located at the first position, the protrusion 56 fits in the concave portion ME. That is, in a state where the cam 55 is located at the first position, the lock release member 52 is fixed relative to the development cartridge 9. As shown in FIG. 12B, in a state where the cam 57 is located at the pressing position, the cam 55 is located at the second position. With this configuration, in a state where the cam 55 is located at the second position, the protrusion 56 separates from the concave portion ME. That is, in a state where the cam 55 is located at the second position, the lock release member 52 is configured to rotatably move relative to the development cartridge 9.

As shown in FIG. 11, the arm 53B is located away from the arm 53A in the axial direction. The one end portion E11 of the arm 53B is rotatably attached to a side surface S2 at the other side of the waste-toner container 51 in the axial direction. As in the arm 53A, the arm 53B includes a cam 55, a protrusion 56, a cam 57, and two wires 58A, 58B.

5.2.2 Grip 54

As shown in FIG. 2, the grip 54 is located away from the grip 34. In other words, the lock release member 52 is located away from the grip 34. The grip 54 is gripped by the user when the user detaches the development cartridge 9 from the second drawer 6. As shown in FIG. 11, the grip 54 includes a bar 54A and the operation portion 54B.

The bar 54A is located between the other end portion E12 of the arm 53A and the other end portion E12 of the arm 53B in the axial direction. The bar 54A extends in the axial direction. One end of the bar 54A in the axial direction is connected to the other end portion E12 of the arm 53A. The other end of the bar 54A in the axial direction is connected to the other end portion E12 of the arm 53B. The bar 54A is fixed to the arm 53A and the arm 53B.

The operation portion 54B is aligned with the bar 54A in the direction in which the arm 53A extends. The operation portion 54B is located between the other end portion E12 of the arm 53A and the other end portion E12 of the arm 53B in the axial direction. The operation portion 54B extends in the axial direction. One end of the operation portion 54B in the axial direction is supported by the other end portion E12 of the arm 53A so as to be movable in the direction in which the arm 53A extends. The other end of the operation portion 54B in the axial direction is supported by the other end portion E12 of the arm 53B so as to be movable in the direction in which the arm 53A extends. With this configuration, the operation portion 54B is configured to move between a separation position (see FIG. 12A) at which the operation portion 54B is separated from the bar 54A and an adjacent position (see FIG. 12B) at which the operation portion 54B is closer to the bar 54A than at the separation position, in the direction in which the arm 53A extends. The wire 58A of the arm 53A is connected to one end of the operation portion 54B in the axial direction. The wire 58A of the arm 53B is connected to the other end of the operation portion 54B in the axial direction. With this configuration, the cams 57 and 55 of the arm 53A and the cams 57 and 55 of the arm 53B move in conjunction with movement of the operation portion 54B. That is, the operation portion 54B is used for an operation of moving the cam 55 between the first position and the second position. In a state where the operation portion 54B is located at the separation position, the cam 57 of the arm 53A and the cam 57 of the arm 53B are located at the non-pressing position, and the cam 55 of the arm 53A and the cam 55 of the arm 53B are located at the first position. In a state where the operation portion 54B is located at the adjacent position, the cam 57 of the arm 53A and the cam 57 of the arm 53B are located at the pressing position, and the cam 55 of the arm 53A and the cam 55 of the arm 53B are located at the second position.

6. Replacement Operation of Development Cartridge 9 and Drum Cartridge 7

Next, a replacement operation of the development cartridge 9 and the drum cartridge 7 will be described while referring to FIGS. 1, 2, 12B, 13, and 14.

As shown in FIG. 1, when a user replaces the development cartridge 9 without replacing the drum cartridge 7, in a state where the first drawer 5 supporting the drum cartridge 7 is located at the first mount position and the second drawer 6 supporting the development cartridge 9 is located at the second mount position, the user moves the cover 3 from the closed position to the open position and then grips the grip 54 to move the operation portion 54B from the separation position to the adjacent position.

Then, as shown in FIG. 12B, the lock member 33A and lock member 33B are located at the lock release position, and a lock state of the first drawer 5 and the second drawer 6 is released.

Figure 13:
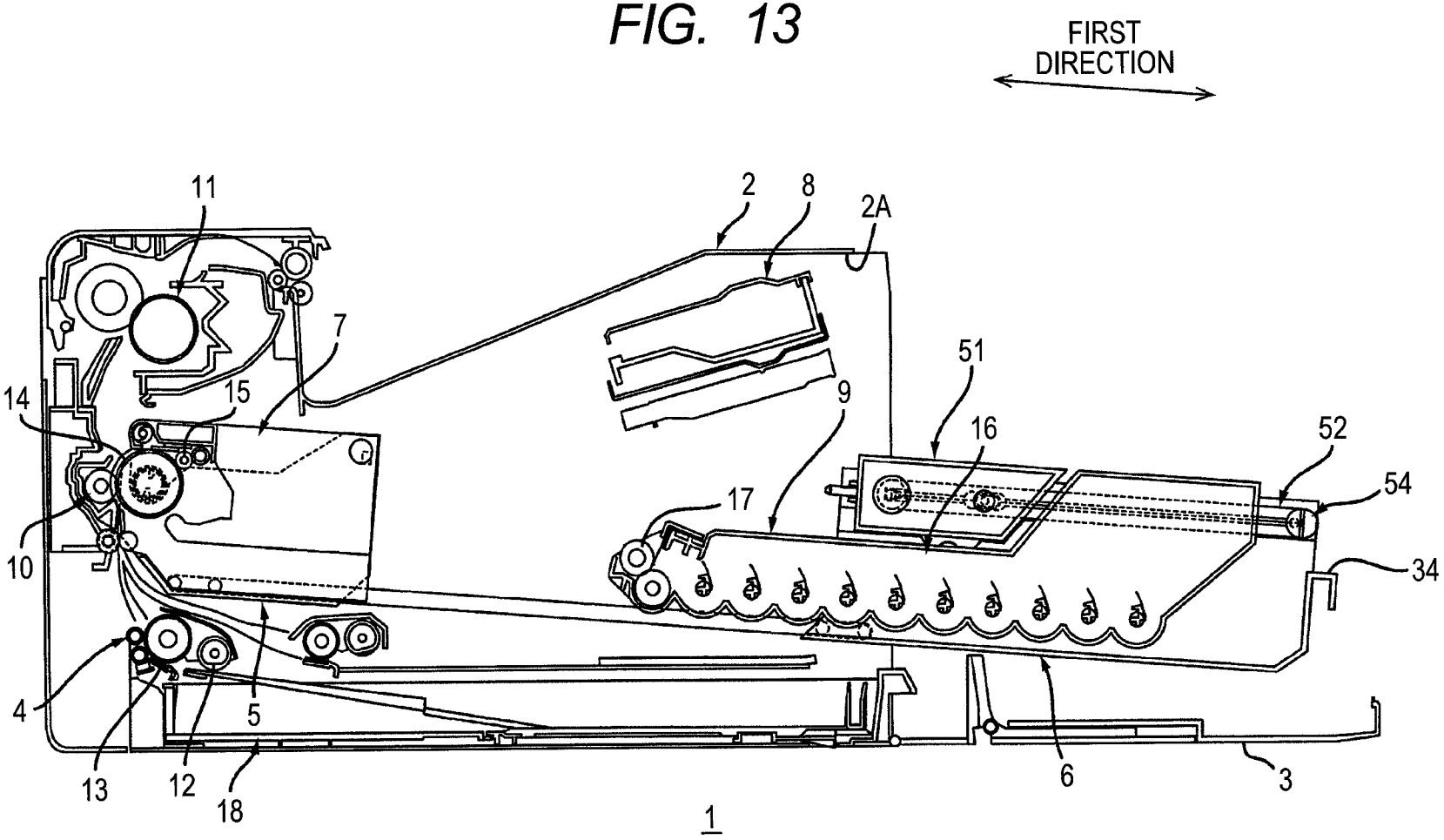
FIG. 13 is an explanatory diagram for illustrating an operation in which a user replaces the development cartridge without replacing the drum cartridge, and showing a state where the first drawer supporting the drum cartridge is located at a first mount position and the second drawer supporting the development cartridge is located at a second detachment position.

Next, as shown in FIG. 13, in a state where the operation portion 54B is located at the adjacent position, the user pulls the grip 54 to pull the second drawer 6 supporting the development cartridge 9 out of the housing 2.

Then, as shown in FIG. 14, in a state where the second drawer 6 supporting the development cartridge 9 is located at the second detachment position, the user rotatably moves the lock release member 52 and detaches the development cartridge 9 from the second drawer 6.

In this way, the user can replace the development cartridge 9 without replacing the drum cartridge 7.

As shown in FIG. 2, when the user replaces both the drum cartridge 7 and the development cartridge 9, the user grips the grip 34 to pull the second drawer 6 out of the housing 2 without gripping the grip 54.

Then, because the first drawer 5 and the second drawer 6 are locked together, the first drawer 5 is pulled out to a position close to the opening 2A, together with the second drawer 6. In a state where the second drawer 6 is located at the second detachment position, the first drawer 5 is located at the first detachment position.

After that, the user first detaches the development cartridge 9 from the second drawer 6, and then detaches the drum cartridge 7 from the first drawer 5.

In this way, the user also can replace both the drum cartridge 7 and the development cartridge 9.

7. Operations and Effects (1) According to the image forming apparatus 1, as shown in FIG. 13, the user causes the lock members 33A, 33B to be located at the lock release position to release the lock state of the first drawer 5 and the second drawer 6, thereby causing the second drawer 6 to separate from the first drawer 5 and to be located at the second detachment position.

In this way, the development cartridge 9 can be replaced without replacing the drum cartridge 7. That is, the drum cartridge 7 and the development cartridge 9 can be replaced separately.

Even in a case where the volume of the development cartridge 9 is increased, the user can replace the development cartridge 9 by just lifting the development cartridge 9 from the second drawer 6. Thus, when the user replaces the development cartridge 9, the drum cartridge 7 supported by the first drawer 5 located at the first mount position does not hinder the replacement operation of the development cartridge 9.

As shown in FIG. 2, by causing the lock members 33A, 33B to be located at the lock position in order to lock the first drawer 5 and the second drawer 6 together, the second drawer 6 is located at the second detachment position and the first drawer 5 is located at the first detachment position.

With this operation, both the drum cartridge 7 and the development cartridge 9 can be replaced.

(2) As shown in FIG. 12A, the lock release member 52 includes the cam 55 and the grip 54. The grip 54 includes the operation portion 54B. When the user moves the operation portion 54B from the separation position (see FIG. 12A) to the adjacent position (see FIG. 12B), the cam 55 causes the lock member 33A to be located at the lock release position.

Thus, when the user replaces the development cartridge 9 without replacing the drum cartridge 7, by performing a series of operations of gripping and pulling the grip 54, the user can release the lock state of the first drawer 5 and the second drawer 6 and pull the second drawer 6 supporting the development cartridge 9 out of the housing 2.

In this way, operability can be improved in a case where the user replaces the development cartridge 9 without replacing the drum cartridge 7.

(3) According to the image forming apparatus 1, as shown in FIG. 2, the second drawer 6 includes the grip 34 at a position separate from the lock release member 52.

With this configuration, when the user does not operate the lock release member 52, that is, when the user replaces both the drum cartridge 7 and the development cartridge 9, the user can grip the grip 34 to pull out the second drawer 6 without gripping the grip 54 of the lock release member 52.

Thus, when the user replaces both the drum cartridge 7 and the development cartridge 9, the user can be prevented from releasing the lock state of the first drawer 5 and the second drawer 6 by mistake.

(4) According to the image forming apparatus 1, as shown in FIG. 1, the development cartridge 9 includes the waste-toner container 51. In a state where the first drawer 5 supporting the drum cartridge 7 and the second drawer 6 supporting the development cartridge 9 are locked together, the waste-toner conveyance pipe 44 (see FIG. 9B) of the drum cartridge 7 is connected to the waste-toner container 51.

With this configuration, waste toner removed from the circumferential surface of the photosensitive drum 14 by the drum cleaner 43 (see FIG. 9B) can be stored in the waste-toner container 51 through the waste-toner conveyance pipe 44.

As shown in FIG. 14, the waste-toner container 51 storing waste toner can be replaced together with the development cartridge 9.

Further, by pulling out the second drawer 6 supporting the development cartridge 9, the waste-toner container 51 storing waste toner can be pulled out together with the development cartridge 9, and the waste-toner conveyance pipe 44 can be detached from the waste-toner container 51. Thus, the waste-toner conveyance pipe 44 does not get in the way when the development cartridge 9 is lifted from the second drawer 6.

(5) According to the image forming apparatus 1, as shown in FIG. 13, by separating the second drawer 6 from the first drawer 5 to cause the second drawer 6 to be located at the second detachment position, the shaft of the development roller 17 is separated from the guide 47. Thus, the guide 47 does not get in the way when the development cartridge 9 is detached.

8. Modification

While the disclosure has been described in detail with reference to the above aspects thereof, it would be apparent to those skilled in the art that various changes and modifications may be made therein without departing from the scope of the claims. An example is provided below.

A modification will be described while referring to FIGS. 15 to 16B.

8.1 First Drawer 5

Figure 15:
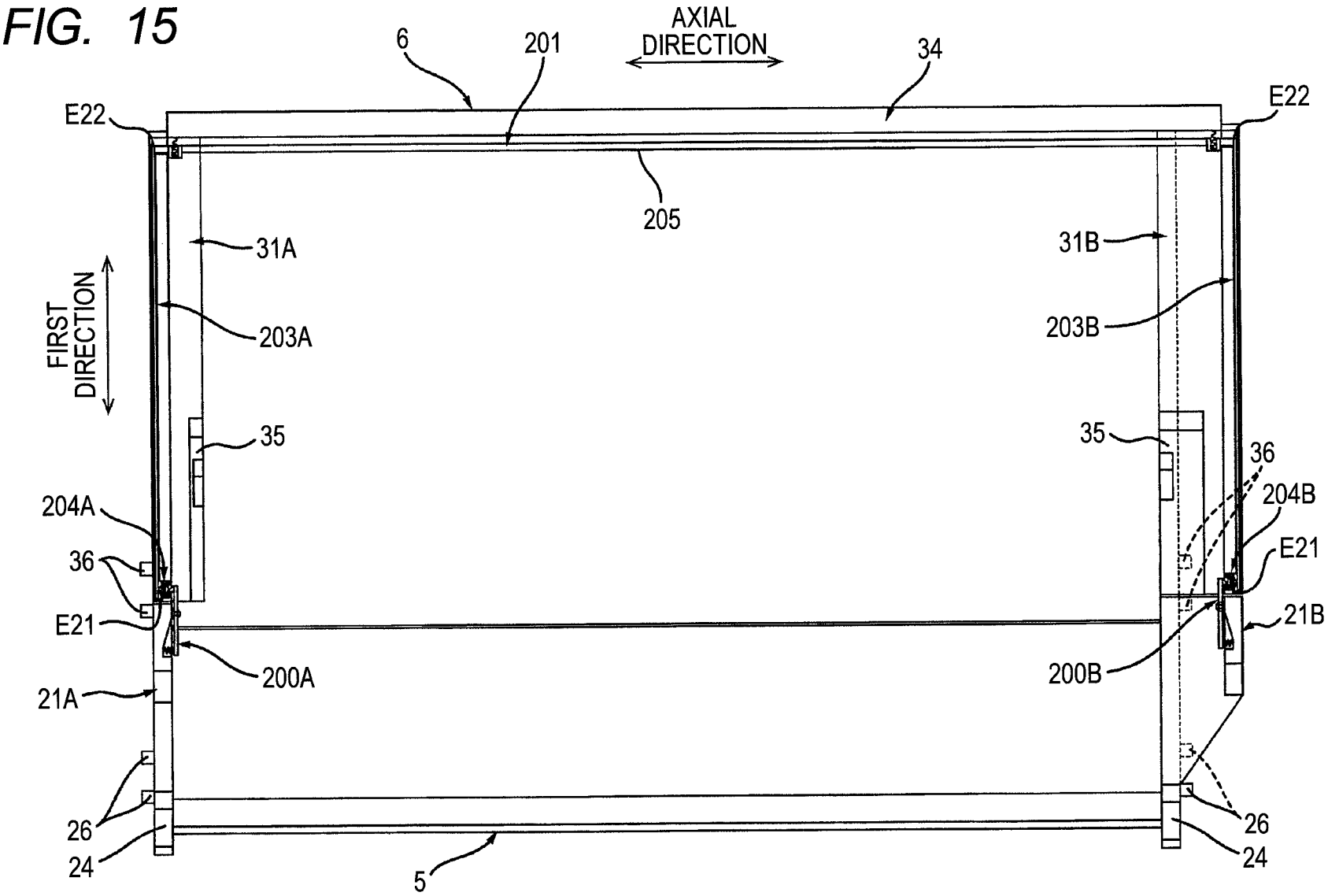
FIG. 15 is a plan view showing a first drawer and a second drawer according to a modification.
Figure 16A:
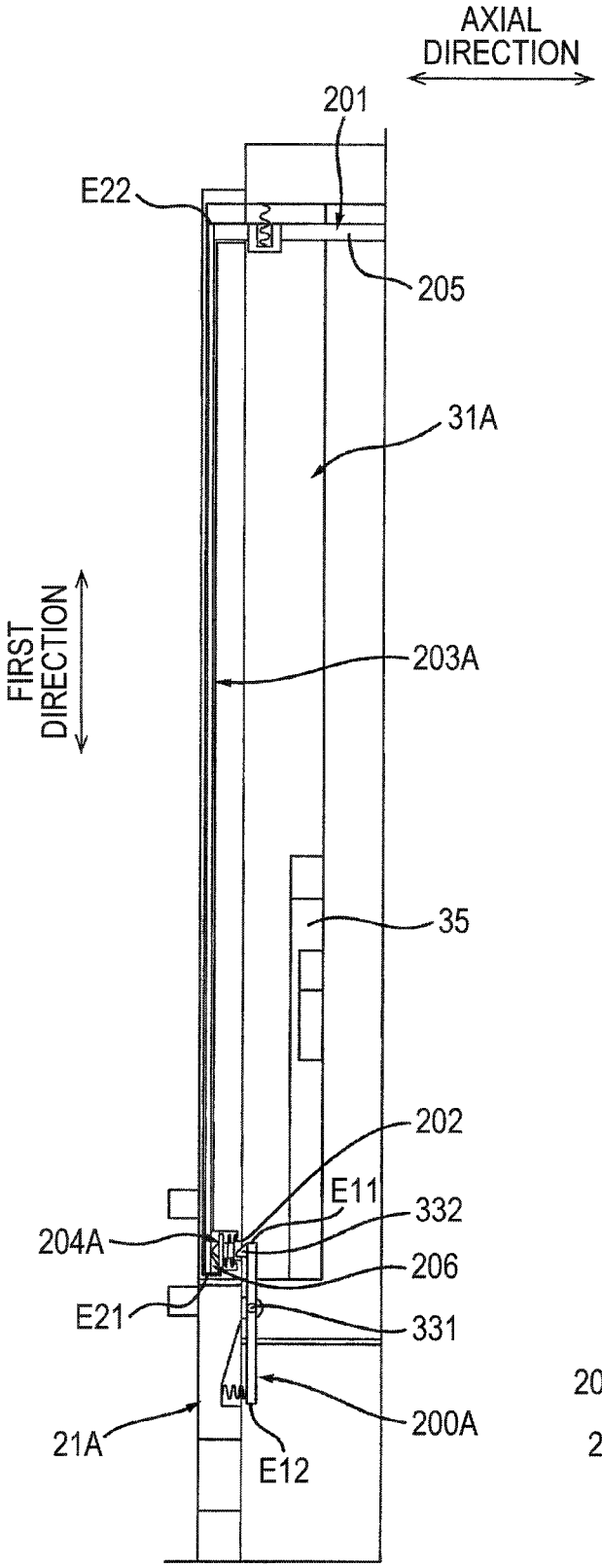
FIG. 16A is an explanatory diagram for illustrating a lock release member shown in FIG. 15 in detail and showing a state where an operation portion is located at a separation position, a cam is located at a first position, and a lock member is located at a lock position.
Figure 16B:
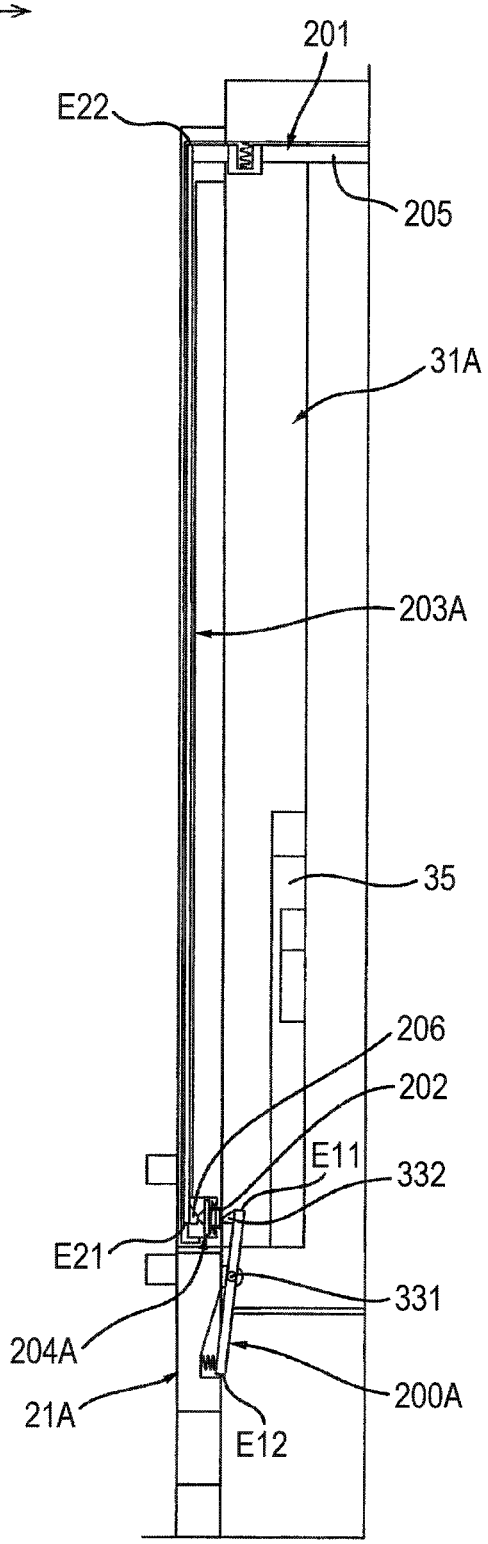
FIG. 16B is an explanatory diagram for illustrating the lock release member in detail, together with FIG. 16A, and showing a state where the operation portion is located at an adjacent position, the cam is located at a second position, and the lock member is located at a lock release position.

As shown in FIGS. 15 and 16A, the first drawer 5 includes two lock members 200A, 200B.

The lock member 200A is attached to the side plate 21A of the first drawer 5. The lock member 200A has a similar structure to the lock member 33A described above. That is, as in the lock member 33A, the lock member 200A extends in the first direction and includes the shaft 331 and the claw 332. The lock member 200A is configured to rotatably move about the shaft 331 between a lock position (see FIG. 16A) and a lock release position (see FIG. 16B).

In a state where the first drawer 5 is located at the first mount position, the second drawer 6 is located at the second mount position, and the lock member 200A is located at the lock position, the claw 332 engages a hole 202 of the second drawer 6. With this configuration, the lock member 200A locks the first drawer 5 and the second drawer 6 together.

In a state where the lock member 200A is located at the lock release position, the claw 332 separates from the hole 202 of the second drawer 6. With this operation, the lock state of the first drawer 5 and the second drawer 6 is released.

As shown in FIG. 15, the lock member 200B is attached to the side plate 21B of the first drawer 5. The lock member 200B has a similar configuration as the lock member 200A, and descriptions thereof are omitted.

8.2 Second Drawer 6

As shown in FIG. 16A, the side plate 31A of the second drawer 6 has the hole 202. The hole 202 of the side plate 31A communicates with the internal space of the side plate 31A. Similarly, the side plate 31B has the hole 202 that communicates with the internal space of the side plate 31B. As shown in FIGS. 15 and 16A, the second drawer 6 includes a lock release member 201.

The lock release member 201 includes two pressing members 204A, 204B, two arms 203A, 203B, and an operation portion 205.

As shown in FIG. 16A, the pressing member 204A is located within the internal space of the side plate 31A. The pressing member 204A extends in the axial direction. The pressing member 204A is configured to move, in the axial direction, between a non-pressing position (see FIG. 16A) and a pressing position (see FIG. 16B). In a state where the pressing member 204A is located at the non-pressing position, the pressing member 204A does not press the lock member 200A located at the lock position. In a state where the pressing member 204A is located at the non-pressing position, the pressing member 204A may separate from the hole 202. In a state where the pressing member 204A is located at the pressing position, the pressing member 204A is inserted in the hole 202. In a state where the pressing member 204A is located at the pressing position, the pressing member 204A causes the lock member 200A to be located at the lock release position. Specifically, when the pressing member 204A moves from the non-pressing position to the pressing position, the pressing member 204A presses the claw 332 of the lock member 200A located at the lock position. Then, the claw 332 of the lock member 200A separates from the hole 202, and the lock member 200A is located at the lock release position.

The pressing member 204B is located within the internal space of the side plate 31B. As in the pressing member 204A, the pressing member 204B causes the lock member 200B (see FIG. 15) to be located at the lock release position.

The arm 203A is located within the internal space of the side plate 31A. The arm 203A extends in the first direction. The arm 203A has one end portion E21 and an other end portion E22 in the first direction. The other end portion E22 is located away from the one end portion E21 in the first direction. The arm 203A is configured to move in the first direction. The arm 203A includes a cam 206. That is, the lock release member 201 includes the cam 206.

The cam 206 is located at the one end portion E21 of the arm 203A. The cam 206 protrudes from the one end portion E21 of the arm 203A. The cam 206 is configured to move between a first position (see FIG. 16A) and a second position (see FIG. 16B) together with the arm 203A. When the cam 206 is located at the first position, the cam 206 does not press the pressing member 204A. Thus, when the cam 206 is located at the first position, the cam 206 allows the pressing member 204A to be located at the non-pressing position and also allows the lock member 200A to be located at the lock position. And, when the cam 206 moves from the first position to the second position, the cam 206 presses the pressing member 204A located at the non-pressing position toward the pressing position. When the cam 206 is located at the second position, the cam 206 causes the pressing member 204A to be located at the pressing position, thereby causing the lock member 200A to be located at the lock release position. In this way, the lock release member 201 causes the lock member 200A located at the lock position to move to the lock release position.

As shown in FIG. 15, the arm 203B is located away from the arm 203A in the axial direction. As in the arm 203A, the arm 203B includes a cam 206.

The operation portion 205 is aligned with the grip 34 in the direction in which the arm 203A extends. The operation portion 205 is located between the other end portion E22 of the arm 203A and the other end portion E22 of the arm 203B in the axial direction. The operation portion 205 is configured to move between a separation position (see FIG. 16A) at which the operation portion 205 is located away from the grip 34 and an adjacent position (see FIG. 16B) at which the operation portion 205 is closer to the grip 34 than at the separation position in the direction in which the arm 203A extends. The operation portion 205 extends in the axial direction. One end of the operation portion 205 in the axial direction connects to the other end portion E22 of the arm 203A. The other end of the operation portion 205 in the axial direction connects to the other end portion E22 of the arm 203B. With this configuration, the cam 206 of the arm 203A and the cam 206 of the arm 203B move in conjunction with movement of the operation portion 205. That is, the operation portion 205 is used for an operation of moving the cam 206 between the first position and the second position. In a state where the operation portion 205 is located at the separation position, the cam 206 of the arm 203A is located at the first position, and the pressing member 204A is located at the non-pressing position. In a state where the operation portion 205 is located at the adjacent position, the cam 206 of the arm 203A is located at the second position, and the pressing member 204A is located at the pressing position.

In this modification, the operations and effects similar to those in the above-described embodiment can be obtained.

What is claimed is:

1. An image forming apparatus comprising:

a housing formed with an opening;

a cover configured to move between a closed position at which the opening is closed and an open position at which the opening is opened;

a drum cartridge including a photosensitive drum;

a development cartridge including a development roller;

a first drawer configured to support the drum cartridge, the first drawer being configured to move in a first direction between a first mount position at which the drum cartridge is mounted on the image forming apparatus and a first detachment position at which the drum cartridge is detachable; and a second drawer including a grip for moving the second drawer, the second drawer configured to support the development cartridge, the second drawer being configured to move in the first direction between a second mount position at which the development cartridge is mounted on the image forming apparatus and a second detachment position at which the development cartridge is detachable, the second drawer being located between the first drawer located at the first mount position and the cover located at the closed position with respect to the first direction in a state where the second drawer is located at the second mount position, wherein, in a state where the second drawer is located at the second mount position, the second drawer overlaps the first drawer located at the first mount position as viewed from the first direction.

2. The image forming apparatus according to claim 1, further comprising an exposure device, wherein the development cartridge includes a toner container configured to store toner supplied to the photosensitive drum; and wherein, in a state where the second drawer is located at the second mount position, the toner container overlaps the exposure device as viewed from a vertical direction.

3. The image forming apparatus according to claim 1, wherein the first drawer is configured to move between the first mount position and the first detachment position within the housing; and wherein the second drawer is configured to move through the opening between the second mount position at which the second drawer is located within the housing and the second detachment position at which at least part of the second drawer is located outside the housing.

4. The image forming apparatus according to claim 1, wherein the drum cartridge further includes:

a drum cleaner configured to clean a circumferential surface of the photosensitive drum; and a waste-toner conveyance pipe configured to convey waste toner that is removed from the circumferential surface of the photosensitive drum by the drum cleaner;

wherein the development cartridge further includes a waste-toner container configured to store the waste toner; and wherein the waste-toner conveyance pipe is connected to the waste-toner container in a state where the first drawer supporting the drum cartridge and the second drawer supporting the development cartridge are locked together.

5. The image forming apparatus according to claim 4, wherein the development cartridge further includes a toner container configured to store toner that is supplied to the photosensitive drum; and wherein the waste-toner container is configured to swingably move relative to the toner container.

6. The image forming apparatus according to claim 1, wherein the first drawer includes a first guided portion;

wherein the second drawer includes a second guided portion; and wherein the image forming apparatus further includes a main guide configured to guide both the first guided portion and the second guided portion, the main guide extending in the first direction.

7. The image forming apparatus according to claim 6, wherein, in a state where the first drawer is located at the first mount position and the second drawer is located at the second mount position, a distance in the first direction between the second guided portion and the cover located at the closed position is shorter than a distance in the first direction between the first guided portion and the cover located at the closed position.

8. The image forming apparatus according to claim 6, wherein each of the first guided portion and the second guided portion is a boss that protrudes in an axial direction in which an axis of the photosensitive drum extends; and wherein the main guide is a groove that is concave in the axial direction.

9. The image forming apparatus according to claim 1, wherein the first drawer has a cutout in which an end portion of the photosensitive drum fits in a state where the drum cartridge is mounted on the first drawer.

* * * * *